US008222185B2

(12) United States Patent
Oguma et al.

(10) Patent No.: US 8,222,185 B2
(45) Date of Patent: Jul. 17, 2012

(54) HEAT-SENSITIVE TRANSFER SHEET AND IMAGE FORMING METHOD

(75) Inventors: Kazuaki Oguma, Minami-ashigara (JP); Naotsugu Muro, Minami-ashigara (JP)

(73) Assignee: FUJIFILM Corporation, Tokyo (JP)

( * ) Notice: Subject to any disclaimer, the term of this patent is extended or adjusted under 35 U.S.C. 154(b) by 434 days.

(21) Appl. No.: 12/549,086

(22) Filed: Aug. 27, 2009

(65) Prior Publication Data

US 2010/0051184 A1 Mar. 4, 2010

(30) Foreign Application Priority Data

Aug. 28, 2008 (JP) ..... 2008-220255

(51) Int. Cl.
*B41M 5/035* (2006.01)
*B41M 5/385* (2006.01)

(52) U.S. Cl. ..... 503/227; 8/471

(58) Field of Classification Search ..... None
See application file for complete search history.

(56) References Cited

U.S. PATENT DOCUMENTS

| | | | | |
|---|---|---|---|---|
| 5,250,495 | A * | 10/1993 | Saito et al. | 503/227 |
| 7,005,166 | B2 * | 2/2006 | Narita et al. | 428/32.76 |
| 7,816,064 | B2 * | 10/2010 | Oguma et al. | 430/201 |

FOREIGN PATENT DOCUMENTS

| | | | |
|---|---|---|---|
| JP | 1-208193 | A | 8/1989 |
| JP | 4-142988 | A | 5/1992 |
| JP | 4-221695 | A | 8/1992 |
| JP | 5-229266 | A | 9/1993 |
| JP | 06-099676 | A | 4/1994 |
| JP | 7-102746 | A | 11/1995 |
| JP | 7-102746 | B | 11/1995 |
| JP | 8-112973 | A | 5/1996 |
| JP | 9-99648 | A | 4/1997 |
| JP | 09-202058 | A | 8/1997 |
| JP | 11-301125 | A | 11/1999 |
| JP | 2005-231354 | A | 9/2005 |
| JP | 2006-281633 | A | 10/2006 |
| JP | 2007-237622 | A | 9/2007 |

* cited by examiner

*Primary Examiner* — Bruce H Hess
(74) *Attorney, Agent, or Firm* — Sughrue Mion, PLLC

(57) ABSTRACT

A heat-sensitive transfer sheet at least having a polyester support, a barrier layer, a heat-sensitive transfer layer containing a dye and a binder, both layers being applied on a surface of the support in this order, and having the heat-sensitive transfer layer including yellow, magenta, and cyan heat-sensitive transfer layers, and the yellow, magenta, and cyan heat-sensitive transfer layers and a protective layer being formed in area order, wherein the barrier layer contains a polyvinylpyrrolidone and cyan heat-sensitive transfer layer contains at least one silicone oil and at least one dye represented by the following formula (C1):

Formula (C1)

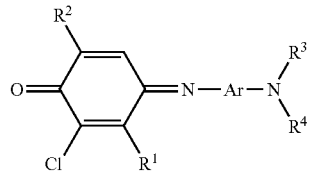

wherein Ar represents a substituted or unsubstituted p-phenylene group; $R^1$ represents a substituted or unsubstituted alkyl group; $R^2$ represents a substituted or unsubstituted acylamino group, or a substituted or unsubstituted alkoxycarbonylamino group; $R^3$ and $R^4$ each independently represent a substituted or unsubstituted alkyl group, a substituted or unsubstituted alkenyl group, or a substituted or unsubstituted aryl group.

12 Claims, No Drawings

HEAT-SENSITIVE TRANSFER SHEET AND IMAGE FORMING METHOD

FIELD OF THE INVENTION

The present invention relates to a heat-sensitive transfer sheet and an image forming method which comprises providing a heat-sensitive transfer sheet and a heat-sensitive transfer image-receiving sheet, and forming an image by applying heat from a thermal head to transfer dyes. Particularly, the present invention provides a heat-sensitive transfer sheet which is resistant to irregular transfer, excellent in maximum transfer density, reduced in gloss unevenness after transferring of a protective layer to a printed product and is also reduced in lack of uniformity in low-density portions; and also provides an image forming method using the same.

BACKGROUND OF THE INVENTION

Various heat transfer recording methods have been known so far. Among these methods, dye diffusion transfer recording systems attract attention as a process that can produce a color hard copy having an image quality closest to that of silver halide photography. Moreover, this system has advantages over silver halide photography: it is a dry system, it enables direct visualization from digital data, it makes reproduction simple, and the like.

In the fields of the dye diffusion transfer recording system, various printers capable of printing at a higher speed than conventional printers have been recently developed and distributed in the markets. High speed printing is a performance required to shorten the time required for users who use self service printers to wait at the shop until printing is finished.

In recent years, good circumstances for users who print at the shop have been prepared and there are therefore many opportunities afforded for the installation of printers out of doors. The outdoor environment in summer is severer than indoor environments in the point of temperature and humidity. This gives rise to such a new problem that when a high-temperature printing in association with high-speed printing is made in a high humidity environment in summer, gloss unevenness involving many fine cells that are considered to be derived from steam in the atmosphere appear on a printed product. This problem, on the contrary, leads easy occurrence of lack of uniformity on the highlight part, in a severe environment of a low-temperature and low-humidity environment in winter.

In the meantime, it is known to use indoaniline type dyes as dyes (see JP-A-6-99676 ("JP-A" means unexamined published Japanese patent application)), and to use silicone oil in a heat-sensitive transfer layer (see JP-A-9-202058). It is also known to form a barrier layer between the support and the heat-sensitive transfer layer (see JP-B-7-102746 ("JP-B" means examined Japanese patent publication) and JP-A-2005-231354).

However, the heat-sensitive transfer sheets described in these documents are unnecessarily satisfactory to solve the above problems and it is therefore desired to provide a solution to these problems.

SUMMARY OF THE INVENTION

The present invention resides in a heat-sensitive transfer sheet at least having a polyester support, a barrier layer, and a heat-sensitive transfer layer containing a dye and a binder, both layers being applied on a surface of the support in this order, and having the heat-sensitive transfer layer including yellow, magenta, and cyan heat-sensitive transfer layers, and the yellow, magenta, and cyan heat-sensitive transfer layers and a protective layer being formed in area order, wherein the barrier layer contains a polyvinylpyrrolidone and the cyan heat-sensitive transfer layer contains at least one silicone oil and at least one dye represented by the following formula (C1):

Formula (C1)

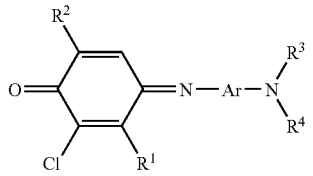

wherein Ar represents a substituted or unsubstituted p-phenylene group; $R^1$ represents a substituted or unsubstituted alkyl group; $R^2$ represents a substituted or unsubstituted acylamino group, or a substituted or unsubstituted alkoxycarbonylamino group; $R^3$ and $R^4$ each independently represent a substituted or unsubstituted alkyl group, a substituted or unsubstituted alkenyl group, or a substituted or unsubstituted aryl group.

Further, the present invention resides in an image forming method comprising: providing a heat-sensitive transfer sheet at least having a polyester support, a barrier layer, and a heat-sensitive transfer layer containing a dye and a binder, both layers being applied on a surface of the support in this order, and having the heat-sensitive transfer layer including yellow, magenta, and cyan heat-sensitive transfer layers, and the yellow, magenta, and cyan heat-sensitive transfer layers and a protective layer being formed in area order; and a heat-sensitive transfer image-receiving sheet at least having a support, and a receptor layer which receives the dyes transferred from the heat-sensitive transfer sheet, on a surface of the support, and transferring the dyes contained in the heat-sensitive transfer layers to the receptor layer of the heat-sensitive transfer image-receiving layer by applying heat to the heat-sensitive transfer sheet from a thermal head to thereby form an image, wherein the heat-sensitive transfer sheet contains a polyvinylpyrrolidone in the barrier layer and the cyan heat-sensitive transfer layer contains at least one silicone oil and at least one dye represented by the following formula (C1):

Formula (C1)

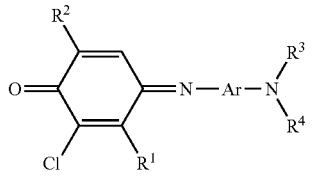

wherein Ar represents a substituted or unsubstituted p-phenylene group; $R^1$ represents a substituted or unsubstituted alkyl group; $R^2$ represents a substituted or unsubstituted acylamino group, or a substituted or unsubstituted alkoxycarbonylamino group; $R^3$ and $R^4$ each independently represent a substituted or unsubstituted alkyl group, a substituted or unsubstituted alkenyl group, or a substituted or unsubstituted aryl group.

Other and further features and advantages of the invention will appear more fully from the following description.

DETAILED DESCRIPTION OF THE INVENTION

The present invention provides a heat-sensitive transfer image-receiving sheet which is excellent in maximum transfer density and is free from image defects; and an image forming method using the same. Specifically, the present invention provides a heat-sensitive transfer sheet which is resistant to irregular transfer, is excellent in maximum transfer density, is excellent in the light fastness for a printed product after the image transfer, is free from defects such as cutting and wrinkling of the heat-sensitive transfer sheet in the transferring operation, and is also reduced in gloss unevenness of the printed product after the transferring of a protective layer, and also provides an image forming method using the same.

According to the present invention, there are provided the following means:

(1) A heat-sensitive transfer sheet at least having a polyester support, a barrier layer, and a heat-sensitive transfer layer containing a dye and a binder, both layers being applied on a surface of the support in this order, and having the heat-sensitive transfer layer including yellow, magenta, and cyan heat-sensitive transfer layers, and the yellow, magenta, and cyan heat-sensitive transfer layers and a protective layer being formed in area order, wherein the barrier layer contains a polyvinylpyrrolidone and the cyan heat-sensitive transfer layer contains at least one silicone oil and at least one dye represented by the following formula (C1):

Formula (C1)

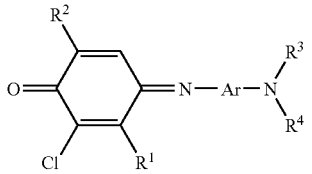

wherein Ar represents a substituted or unsubstituted p-phenylene group; $R^1$ represents a substituted or unsubstituted alkyl group; $R^2$ represents a substituted or unsubstituted acylamino group, or a substituted or unsubstituted alkoxycarbonylamino group; $R^3$ and $R^4$ each independently represent a substituted or unsubstituted alkyl group, a substituted or unsubstituted alkenyl group, or a substituted or unsubstituted aryl group.

(2) The heat-sensitive transfer sheet according to the above (1), wherein the barrier layer further contains inorganic fine particles.

(3) An image forming method comprising:

providing a heat-sensitive transfer sheet at least having a polyester support, a barrier layer, and a heat-sensitive transfer layer containing a dye and a binder, both layers being applied on a surface of the support in this order, and having the heat-sensitive transfer layer including yellow, magenta, and cyan heat-sensitive transfer layers, and the yellow, magenta, and cyan heat-sensitive transfer layers and a protective layer being formed in area order; and a heat-sensitive transfer image-receiving sheet at least having a support, and a receptor layer which receives the dyes transferred from the heat-sensitive transfer sheet, on a surface of the support, and transferring the dyes contained in the heat-sensitive transfer layers to the receptor layer of the heat-sensitive transfer image-receiving layer by applying heat to the heat-sensitive transfer sheet from a thermal head to thereby form an image, wherein the heat-sensitive transfer sheet contains a polyvinylpyrrolidone in the barrier layer and the cyan heat-sensitive transfer layer contains at least one silicone oil and at least one dye represented by the following formula (C1):

Formula (C1)

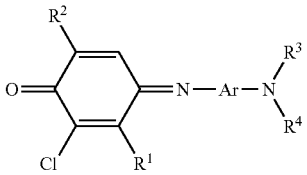

wherein Ar represents a substituted or unsubstituted p-phenylene group; $R^1$ represents a substituted or unsubstituted alkyl group; $R^2$ represents a substituted or unsubstituted acylamino group, or a substituted or unsubstituted alkoxycarbonylamino group; $R^3$ and $R^4$ each independently represent a substituted or unsubstituted alkyl group, a substituted or unsubstituted alkenyl group, or a substituted or unsubstituted aryl group.

(4) The image forming method according to the above (3), wherein the barrier layer of the heat-sensitive transfer sheet further contains inorganic fine particles.

(5) The image forming method according to the above (3) or (4), wherein the heat-sensitive transfer image-receiving sheet contains at least one type of latex polymer in the receptor layer.

(6) The image forming method according to any one of the above (3) to (5), wherein the above latex polymer is a vinyl chloride type latex polymer.

The present invention is explained in detail below.

<<Heat-Sensitive Transfer Sheet>>

First, the heat-sensitive transfer sheet is explained.

The heat-sensitive transfer sheet of the present invention includes a polyester support, a barrier layer, and a heat-sensitive transfer layer (also referred to as "thermal transfer layer) containing a dye and a binder, both the barrier and heat-sensitive transfer layers being applied to the support in the order of mention, in which the heat-sensitive transfer layer includes a yellow heat-sensitive transfer layer, a magenta heat-sensitive transfer layer, and a cyan heat-sensitive transfer layer, and the yellow heat-sensitive transfer layer, the magenta heat-sensitive transfer layer, and the cyan heat-sensitive transfer layer, and a protective layer are formed in area order.

The term "forming layers in area order" as used herein means forming prescribed areas of heat-sensitive transfer layers that respectively are different in colors and/or functions in the longitudinal direction on the support of the heat-sensitive transfer sheet, by forming them in order.

(Barrier Layer)

The present invention is provided with a barrier layer between the support and the heat-sensitive transfer layer. The barrier layer prevents dyes from transferring to the support of the heat-sensitive transfer sheet.

In the barrier layer, a water-soluble polymer is preferably used. In the present invention, at least one type of polyvinylpyrrolidones is contained in the barrier layer. The polyvinylpyrrolidones are polymers having a repeating unit derived from vinylpyrrolidone and may be either a homopolymer or a copolymer.

As the polyvinylpyrrolidones (hereinafter also referred to as "PVP"), those having a number average molecular weight of about 30,000 to 280,000 are preferable. If the molecular weight is too small, only a small dye barrier effect is obtained, whereas if the molecular weight is too large, the coatability tends to be impaired. As the PVP, commercially available ones may be used, and examples thereof include polyvinylpyrrolidone resins (K-60), (K-90), and (K-120) manufactured by ISP.

In a preferred embodiment, PVP may be crosslinked. As the crosslinked PVP, commercially available ones may be used. Specifically, VIVIPRINT (trade name) 540 manufactured by ISP and the like may be used. A copolymer obtained by substituting a part of PVP with other polymers may also be used. Examples of such a copolymer include copolymers of PVP and styrene and copolymers of PVP and vinyl acetate. Specific examples of the PVP/vinyl acetate copolymer include PVPNA copolymers Grade I-335, I-535, I-635, and I-735 manufactured by ISP; and specific examples of the PVP/styrene copolymer include ANTARA430 manufactured by ISP. Each of these water-soluble polymers may be dissolved or dispersed in a solvent such as water or alcohol, to prepare a coating solution, and then applied by a known coating means such as gravure printing and screen printing, to form a barrier layer.

The polyvinylpyrrolidones contained in the barrier layer may be used either singly or in combinations of two or more kinds. Also, the polyvinylpyrrolidones may be used together with other water-soluble polymers.

As the water-soluble polymers, natural polymers, semi-synthetic polymers, and synthetic polymers are preferably used.

Specific examples of the natural polymers and semi-synthetic polymers include the following polymers: plant type polysaccharides such as κ-carrageenans, ι-carrageenans, λ-carrageenans, and pectins; microbial type polysaccharides such as xanthan gums and dextrins; animal type natural polymers such as gelatins and caseins; and cellulose-based polymers such as carboxymethylcelluloses, hydroxyethylcelluloses, and hydroxypropylcelluloses.

Of the natural polymers and the semi-synthetic polymers, gelatin is preferred. Gelatin having a molecular weight of 10,000 to 1,000,000 may be used. Gelatin may contain an anion such as C1 and $SO_4^{2-}$, or alternatively a cation such as $Fe^{2+}$, $Ca^{2+}$, $Me^{+}$, $Sn^{2+}$, and $Zn^{2+}$. Gelatin is preferably added as an aqueous solution.

Of the water-soluble polymers, examples of the synthetic polymers include polyvinyl alcohol, polyethylene glycol, polypropylene glycol, and water-soluble polyesters.

Among the synthetic polymers, polyvinyl alcohols are preferable.

As the polyvinyl alcohol, there can be used various kinds of polyvinyl alcohols such as complete saponification products thereof, partial saponification products thereof, and modified polyvinyl alcohols. With respect to these polyvinyl alcohols, those described in Koichi Nagano et al., "Poval", Kobunshi Kankokai, Inc. are useful.

The viscosity of polyvinyl alcohol can be adjusted or stabilized by adding a trace amount of a solvent or an inorganic salt to an aqueous solution of polyvinyl alcohol, and use may be made of compounds described in the aforementioned reference "Poval", Koichi Nagano et al., published by Kobunshi Kankokai, pp. 144-154. For a typical example, a coated-surface quality can be improved by an addition of boiic acid, and the addition of boric acid is preferable. The amount of boric acid to be added is preferably 0.01 to 40 mass %, with respect to polyvinyl alcohol.

Specific examples of the polyvinyl alcohols include completely saponificated polyvinyl alcohol such as PVA-105, PVA-110, PVA-117, and PVA-117H; partially saponificated polyvinyl alcohol such as PVA-203, PVA-205, PVA-210, and PVA-220; and modified polyvinyl alcohols such as C-118, HL-12E, KL-118, and MP-203 (all of these names are trade names, manufactured by KURARAY CO., LTD.).

In the present invention, it is preferable to use a combination of a polyvinylpyrrolidone and a modified polyvinylpyrrolidone or a combination of a polyvinylpyrrolidone and a water-soluble polymer other than polyvinylpyrrolidones and modified polyvinyipyrrolidones, in order to produce the effect of the present invention efficiently. Here, the amount of the modified polyvinylpyrrolidone or the above hydrophilic polymer used together with the above polyvinylpyrrolidone is preferably less than 50% based on the total solid content of the water-soluble polymer used in the barrier layer. The lower limit of the amount is preferably 1%.

The solid content of the barrier layer comprised of the water-soluble polymer including polyvinylpyrrolidones after the barrier layer is dried is preferably 0.01 to 0.3 $g/m^2$ and more preferably 0.05 to 0.1 $g/m^2$. If the amount is too large (i.e. the barrier layer is too thick), the heat conductivity of the barrier layer is deteriorated, which rather brings about a reduced effect on an improvement in transferability which is the function of the barrier layer. If the amount is too small (i.e. the barrier layer is too thin), this causes large coating unevenness and hence inferior adhesion.

The barrier layer preferably contains inorganic fine particles and preferably, a water dispersion of inorganic fine particles.

As the raw material of the inorganic fine particle used for the water dispersion inorganic fine particles, conventionally known materials may be used. Examples of these raw material include colloidal silica, alumina, colloidal alumina, magnesium silicate, magnesium carbonate, and titanium oxide. Among these materials, colloidal silica and colloidal alumina (hereinafter, these are collectively called "colloidal fine particles") are more preferable.

Here, the term "colloidal silica" means a material obtained by using water as the dispersion medium and by dispersing ultra-fine particles of silicic acid anhydride in water; and the term "colloidal alumina" means a material obtained by using water as the dispersion medium and by dispersing ultra-fine particles of aluminum oxide in water.

Also, as the shape of these particles, various shapes such as a spherical, needle or plate shape may be used. The average particle diameter is preferably 100 nm to 50 nm and more preferably 10 to 30 nm. As these colloidal silica and colloidal alumina, commercially available ones may be used. Examples of the colloidal silica include those commercially available under the name of Snowtex OSX, Snowtex XS, Snowtex S, and Snowtex OS (all trade names), manufactured by Nissan Chemical Industries, Ltd. Examples of the colloidal alumina include those commercially available under the name of Alumina Sol 100, Alumina Sol 200, and Alumina Sol 520, manufactured by Nissan Chemical Industries, Ltd.

These colloidal fine particles may be used together with other resins. Among resins, it is preferable to use the aforementioned water-soluble polymers together with the colloidal fine particles. Among these water-soluble polymers, it is most preferable to use a polyvinyl alcohol or PVP together with the colloidal fine particles.

A coating solution containing the colloidal fine particle dispersion as its major component may be applied by known means such as gravure printing and screen printing, to form a barrier layer. The solid content of the barrier layer after dried is preferably 0.03 g to 0.3 g/m$^2$ and more preferably 0.03 g to 0.1 g/m$^2$. If the content is too large (i.e., the barrier layer is too thick), the heat conductivity of the barrier layer is deteriorated, which rather brings about a reduced effect on an improvement in transferability which is the function of the barrier layer. If the content is too small, this causes large coating unevenness and hence inferior adhesion.

It is preferred that the barrier layer contain the inorganic fine particles in an amount of 10 to 80 mass %, more preferably 20 to 60 mass %, based on the dry solid content in the barrier layer.

(Heat-Sensitive Transfer Layer)

In the present invention, at least one dye represented by formula (C1) is contained in a cyan heat-sensitive transfer layer.

Formula (C1)

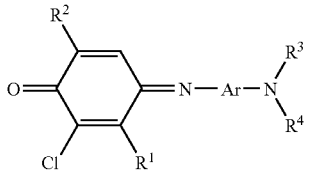

In formula (C1), Ar represents a substituted or unsubstituted p-phenylene group; $R^1$ represents a substituted or unsubstituted alkyl group; $R^2$ represents a substituted or unsubstituted acylamino group, or a substituted or unsubstituted alkoxycarbonylamino group; $R^3$ and $R^4$ each independently represent a substituted or unsubstituted alkyl group, a substituted or unsubstituted alkenyl group, or a substituted or unsubstituted aryl group.

Ar is a substituted or unsubstituted p-phenylene group, and examples of the substituent in the substituted p-phenylene group include an alkyl group, a cycloalkyl group, an alkenyl group, an aryl group, a heterocyclic group, a halogen atom, a hydroxyl group, an alkoxy group, an aryloxy group, an alkylthio group, an arylthio group, an amino group, an alkylamino group, an arylamino group, a heterocyclic amino group, an acylamino group, a sulfonamido group, a carbamoyl group, a sulfamoyl group, an alkoxycarbonylamino group, an alkylsulfonyl group, an arylsulfonyl group, a cyano group, a nitro group, a sulfo group, a carboxyl group, and a mercapto group.

Among these groups, an alkyl group and a halogen atom are preferable, an alkyl group is more preferable, and a methyl group is still more preferable.

Also, though the p-phenylene group may have a plurality of substituents, it preferably has one substituent, and in this case, it preferably has a substituent at the meta-position to the position where —N($R^3$)($R^4$) is connected.

An unsubstituted p-phenylene group is also preferable. However, a p-phenylene group substituted with an alkyl group or halogen atom as described above is more preferable.

As the substituent in the substituted alkyl group represented by $R^1$, the substituted acylamino group and substituted alkoxycarbonylamino group represented by $R^2$, and the substituted alkyl group, substituted alkenyl group, and substituted aryl group represented by $R^3$ or $R^4$, those substituents mentioned as the substituents in the p-phenylene group represented by Ar may be used.

As the alkyl group represented by $R^1$, an unsubstituted alkyl group is preferable, and an alkyl group having 1 to 4 carbon atoms is more preferable. Among these alkyl groups, a methyl group and an ethyl group are preferable, and an ethyl group is most preferable.

The substituted or unsubstituted acylamino group represented by $R^2$ has preferably 2 to 10 carbon atoms, more preferably 2 to 8 carbon atoms, even more preferably 2 to 6 carbon atoms, and most preferably 2 carbon atoms. An unsubstituted acylamino group is more preferable than a substituted acylamino group. As the substituent in the substituted acylamino group, a halogen atom, a hydroxy group, an alkoxy group, an aryloxy group, an alkylthio group, and an arylthio group are preferable.

The substituted or unsubstituted alkoxycarbonylamino group represented by $R^2$ has preferably 2 to 10 carbon atoms, more preferably 2 to 8 carbon atoms, even more preferably 2 to 6 carbon atoms, and most preferably 2 carbon atoms. Also, an unsubstituted alkoxycarbonylamino group is more preferable than a substituted alkoxycarbonylamino group. As the substituent in the substituted alkoxycarbonylamino group, a halogen atom, a hydroxy group, an alkoxy group, an aryloxy group, an alkylthio group, and an arylthio group are preferable.

On the other hand, among substituted or unsubstituted acylamino groups and substituted or unsubstituted alkoxycarbonylamino groups, substituted or unsubstituted acylamino groups are preferable.

$R^3$ and $R^4$ respectively represent a substituted or unsubstituted alkyl group, a substituted or unsubstituted alkenyl group, or a substituted or unsubstituted aryl group. The alkyl group preferably has 1 to 8 carbon atoms, more preferably 1 to 6 carbon atoms, even more preferably 1 to 4 carbon atoms, and most preferably 2 carbon atoms. The alkenyl group preferably has 2 to 8 carbon atoms, and the aryl group preferably has 6 to 12 carbon atoms.

Examples of the alkyl group include methyl, ethyl, isopropyl, n-butyl, t-butyl, hexyl, and octyl. Examples of the alkenyl group include vinyl and allyel. Examples of the aryl group include phenyl and tolyl.

Among these groups, substituted or unsubstituted alkyl groups and substituted or unsubstituted alkenyl groups are preferable, substituted or unsubstituted alkyl groups are more preferable, unsubstituted alkyl groups are even more preferable, and an ethyl group is most preferable. As the substituent of the substituted alkyl group, a halogen atom, a hydroxyl group, an alkoxy group, and a sulfonamido group are preferable.

In a preferable combination of the substituents of the dye represented by the formula (C1), Ar is a p-phenylene group substituted with an alkyl group having 1 to 4 carbon atoms, a p-phenylene group substituted with a chlorine atom, or an unsubstituted p-phenylene group, $R^1$ is a substituted or unsubstituted alkyl group having 1 to 8 carbon atoms, $R^2$ is a substituted or unsubstituted acylamino group having 2 to 10 carbon atoms or a substituted or unsubstituted alkoxycarbonylamino group having 2 to 10 carbon atoms, $R^3$ is a substituted or unsubstituted alkyl group having 1 to 8 carbon atoms, and $R^4$ is a substituted or unsubstituted alkyl group having 1 to 8 carbon atoms.

In a more preferable combination of the substituents, Ar is a p-phenylene group substituted with an alkyl group having 1 to 2 carbon atoms, or an unsubstituted p-phenylene group, $R^1$ is a substituted or unsubstituted alkyl group having 1 to 6 carbon atoms, $R^2$ is a substituted or unsubstituted acylamino group having 2 to 8 carbon atoms or a substituted or unsubstituted alkoxycarbonylamino group having 2 to 8 carbon atoms, $R^3$ is a substituted or unsubstituted alkyl group having 1 to 6 carbon atoms and $R^4$ is a substituted or unsubstituted alkyl group having 1 to 6 carbon atoms.

In the most preferable combination of the substituents, Ar is a p-phenylene group substituted with a methyl group, or an unsubstituted p-phenylene group, $R^1$ is a substituted or unsubstituted alkyl group having 1 to 6 carbon atoms, $R^2$ is a substituted or unsubstituted acylamino group having 2 to 6 carbon atoms or a substituted or unsubstituted alkoxycarbonylamino group having 2 to 6 carbon atoms, $R^3$ is a substituted or unsubstituted alkyl group having 1 to 4 carbon atoms, and $R^4$ is a substituted or unsubstituted alkyl group having 1 to 4 carbon atoms.

Specific examples of the dye represented by the formula (C1) will be shown below. However, the present invention is not limited to these examples.

TABLE 1

Dyes represented by formula (C1)

| Compound examples | Ar | $R^1$ | $R^2$ | $R^3$ | $R^4$ |
|---|---|---|---|---|---|
| C1-1 | 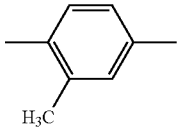 | Methyl | Acetylamino | Ethyl | Ethyl |
| C1-2 | 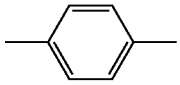 | Hydrogen | 3-pyridinecarbonylamino | n-Propyl | n-Propyl |
| C1-3 | 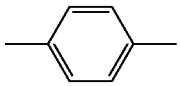 | Methyl | Acetylamino | n-Propyl | n-Propyl |
| C1-4 | 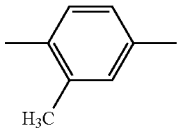 | Ethyl | 2-Furoylamino | Ethyl | Ethyl |

The dye represented by the formula (C1) in the present invention may be used either independently or in combination with other dyes.

It is preferred that the heat-sensitive transfer layer contain the dye represented by the formula (C1) in an amount of 20 to 80 mass %, and more preferably 30 to 70 mass %.

Each of these dyes is preferably applied to the surface of the support in such a state that it is dispersed in a high-molecular compound called a binder. As the binder, various known materials may be used.

Examples of the binder polymers include acrylic resins such as polyacrylonitrile, polyacrylic acid ester, and polyacrylamide; polyvinyl acetal-based resins such as polyvinyl acetacetal, and polyvinyl butyral; cellulose-based resins and modified cellulose-based resins such as ethyl cellulose, hydroxyethyl cellulose, ethylhydroxy cellulose, hydroxypropyl cellulose, ethylhydroxyethyl cellulose, methyl cellulose, cellulose acetate, cellulose acetate butyrate, cellulose acetate propionate, and cellulose nitrate; polyurethane resins; polyamide resins; polyester resins; polycarbonate resins; phenoxy resins; phenol resins; epoxy resins; and various kinds of elastomers. These polymers may be used singly, or in the form of mixture or copolymer thereof.

As the binder that is used in the present invention, polyvinyl acetal-based resins are preferable. More preferable binders are polyvinyl acetoacetal-based resins. More preferably, a polyvinylacetoacetal-based resin in which the acetal content of the resin is 80% by mass or more and an acetoacetal ratio to the acetal content is 90% by mass or more. The aforementioned acetal-based resins can be synthesized according to a method that is described in Japanese Patent No. 3065111 and references cited in the Japanese Patent. Further, there are some commercially available products such as S-LEC KS-5 (trade name, manufactured by SEKISUI CHEMICAL CO., LTD.), and DENKA BUTYRAL #5000-D (trade name, manufactured by DENKI KAGAKU KOGYO K.K.).

In the heat-sensitive transfer sheet of the present invention, it is also one of preferable embodiments to crosslink a binder with a variety of crosslinking agents.

The crosslinking agent is a compound that is able to react with a functional group located at a main chain or a side chain of polymers thereby to bind polymers. As the crosslinking agent, a proper one is selected corresponding to the type of high-molecular compound to be crosslinked. As to typical examples, isocyanates having a plurality of isocyanate groups (—N═C═O) in one molecule are preferably used as the crosslinking agent for high-molecular compounds containing a hydroxyl group having an active hydrogen such as a polyvinylacetal-based resin. Specific examples of the isocyanates are listed below.

(1) Diisocyanate Compound

Examples of aromatic diisocyanates include tolylene diisocyanate, diphenylmethane diisocyanate, tolidine diisocyanate, and naphthalene diisocyanate. Examples of aliphatic diisocyanates include hexamethylene diisocyanate, isophorone diisocyanate, xylylene diisocyanate, hydrogenated xylylene diisocyanate, and dicyclohexylmethane diisocyanate.

(2) Triisocyanate Compound

Examples of the triisocyanate compounds include trimethylolpropane-modified tolylene diisocyanate, isocyanurate of tolylene diisocyanate, trimethylolpropane-modified hexamethylene diisocyanate, isocyanurate of hexamethylene diisocyanate, biuret of hexamethylene diisocyanate, trimethylolpropane-modified isophorone diisocyanate, isocyanurate of isophorone diisocyanate, triphenylmethane triisocyanate, and tris(isocyanatophenyl)thiophosphate.

Further, a mixture of these isocyanate compounds, or a polymer having the isocyanate compound as a component in the main chain or side chain thereof is also preferably used.

These isocyanate compounds are commercially available, for example, from Dainippon Ink & Chemicals Incorporated as a trade name: BURNOCK; Mitsui Chemicals Polyurethanes, Inc. as trade names: TAKENATE, MT-OLESTER; and Nippon Polyurethane Industry Co., Ltd. as a trade name: CORONATE.

The use amount of the isocyanate compounds is preferably in the range of 0.2 to 2.0, and more preferably from 0.3 to 1.5, in terms of equivalent ratio (NCO/H) of the isocyanate group (NCO) to the active hydrogen of the binder (H).

Catalysts may be added in order to accelerate a crosslinking reaction of the binder with the iso cyanate compound. Details of the catalysts are described in "Saishin poriuretan zairyo to Oyo-Gizyutsu (Advanced Polyurethane Materials and Applied Technology)" (Kabushiki kaisha CMC Shuppan, 2005).

(Silicone Oil)

In the present invention, a silicone oil is contained in the heat-sensitive transfer layer.

Gloss unevenness after the protective layer is transferred can be efficiently prevented by incorporating a silicone oil to the heat-sensitive transfer layer containing the dye represented by the formula (C1) and further by combining with a barrier layer containing a polyvinylpyrrolidone.

As the silicone oil, straight silicone oils and modified silicone oils or their hardened products may be used. Both reactive silicone oils and non-reactive silicone oils may be used. Examples of the straight silicone oils include dimethylsilicone oil, methylphenylsilicone oil, and methyl hydrogen silicone oil. Examples of the dimethylsilicone oil include KF96-10, KF96-100, KF96-1000, KF96H-10000, KF96H-12500 and KF96H-100000 (all of these names are trade names, manufactured by Shin-Etsu Chemical Co., Ltd.). Examples of the methylphenylsilicone oils include KF50-100, KF54, and KF56 (all of these names are trade names, manufactured by Shin-Etsu Chemical Co., Ltd.).

The modified silicone oils may be classified into reactive silicone oils and non-reactive silicone oils. Examples of the reactive silicone oils include amino-modified, epoxy-modified, carboxyl-modified, hydroxy-modified, methacryl-modified, mercapto-modified, phenol-modified, or one-terminal reactive/hetero-functional group-modified silicone oils. Examples of the amino-modified silicone oil include KF-393, KF-857, KF-858, X-22-3680, X-22-3801C, KF-8010, X-22-161A and KF-8012 (all of these names are trade names, manufactured by Shin-Etsu Chemical Co., Ltd.). Examples of the epoxy-modified silicone oils include KF-100T, KF-101, KF-60-164, KF-103, X-22-343 and X-22-3000T (all of these names are trade names, manufactured by Shin-Etsu Chemical Co., Ltd.). Examples of the carboxyl-modified silicone oil include X-22-162C (trade name, manufactured by Shin-Etsu Chemical Co., Ltd.). Examples of the hydroxy-modified silicone oils include X-22-160AS, KF-6001, KF-6002, KF-6003, X-22-170DX, X-22-176DX, X-22-176D, and X-22-176DF (all of these names are trade names, manufactured by Shin-Etsu Chemical Co., Ltd.). Examples of the methacryl-modified silicone oil include X-22-164A, X-22-164C, X-24-8201, X-22-174D, and X-22-2426 (all of these names are trade names, manufactured by Shin-Etsu Chemical Co., Ltd.). Among these modified silicone oils, amino-modified silicone oils, and epoxy-modified silicone oils are preferable, further, amino-modified silicone oils are more preferable.

Reactive silicone oils may be hardened upon use, and may be classified into a reaction-curable type, a photocurable type, a catalyst-curable type, and the like. Among these types, silicone oils that are the reaction-curable type are particularly preferable. As the reaction-curable type silicone oil, products obtained by reacting an amino-modified silicone oil with an epoxy-modified silicone oil and then by curing are preferable. Also, examples of the catalyst-curable type or photocurable type silicone oil include KS-705F-PS, KS-705F-PS-1, and KS-770-PL-3 (all of these names are trade names, catalyst-curable silicone oils, manufactured by Shin-Etsu Chemical Co., Ltd.) and KS-720 and KS-774-PL-3 (all of these names are trade names, photocurable silicone oils, manufactured by Shin-Etsu Chemical Co., Ltd.). The addition amount of the curable type silicone oil is preferably 0.5 to 30% by mass based on the resin constituting the heat-sensitive transfer layer. The silicone oil is used preferably in an amount of 2 to 4% by mass, and further preferably 2 to 3% by mass, based on 100 parts by mass of the resin constituting the heat-sensitive transfer layer. If the amount is too small, the releasability of a reliable level cannot be secured, whereas if the amount is excessive, it prevents transfer of the dye.

Examples of the non-reactive silicone oils include polyether-modified, methylstyryl-modified, alkyl-modified, higher fatty acid ester-modified, hydrophilic specially-modified, higher alkoxy-modified, or fluorine-modified silicone oils. Among these compounds, polyether-modified silicones are preferable. Among these silicones, those having an HLB value of 7 or more are more preferable. Specific examples of these compounds include KF-351A, KF-352A, KF-354L, KF-355A, KF-615, KF-640, KF-642, KF-643, KF-6011, and KF-6012 (manufactured by Shin-Etsu Chemical Co., Ltd.).

The amount of the silicone oil to be added is preferably 0.1 to 15% by mass, more preferably 0.5 to 12% by mass, and even more preferably 1 to 10% by mass.

As the yellow dye and magenta dye for use in the present invention, known dyes may be used and known heat-sensitive transfer layers are applied as the yellow heat-sensitive transfer layer and magenta heat-sensitive transfer layer.

(Formation of the Transferable Protective Layer)

The protective layer in the present invention is the so-called transferable protective layer. Though the method of forming this protective layer depends on the type of resin to be used, it is preferable to form the protective layer using the same method as that used for the above heat-sensitive transfer layer. The protective layer preferably has a thickness of about 0.5 to 10 μm.

As the resin for use in preparing the transferable protective layer according to the present invention, preferred are resins having excellent abrasion resistance, chemical resistance, transparency, and hardness; and use can be made of any of polyester resins, acrylic resins, polystyrene resins, polyurethane resins, acrylic urethane resins, silicone-modified resins of the foregoing resins, ultraviolet blocking resins, mixtures of the foregoing resins, ionizing-radiation-curable resins, ultraviolet curable resins, and the like. Among these, preferred are polyester resins and acrylic resins.

These resins may be crosslinked by any of various crosslinking agents.

(Releasing Layer)

In a case where the transferable protective layer is not easily peeled from the support at the time of thermal transferring, a releasing layer may be formed between the support and the protective layer. Alternatively, a peeling layer may be formed between the transferable protective layer and the releasing layer. The releasing layer may be formed by applying a coating liquid by a method known in the prior art, such as gravure coating or gravure reverse coating, and then drying the coated liquid. The coating liquid contains at least one selected from, for example, waxes, silicone waxes, silicone resins, fluorine-containing resins, acrylic resins, polyvinyl alcohol resins, cellulose derivative resins, urethane-series resins, vinyl acetate-series resins, acrylic vinyl ether-series resins, maleic anhydride resins, and copolymers of these resins. Of these resins, preferred are: acrylic resins, such as resin obtained by homopolymerizing a (meth)acrylic monomer such as acrylic acid or methacrylic acid, or obtained by copolymerizing an acrylic or methacrylic monomer with a different monomer; or cellulose derivative resins. They are each excellent in adhesive property to the support sheet, and releasing ability from the protective layer.

These resins may be crosslinked with various crosslinking agents. Moreover, ionizing radiation curable resin and ultraviolet curable resin may also be used.

The releasing layer may be appropriately selected from a releasing layer which is transferred to a transferred-image-receiving member when the protective layer is thermally transferred, a releasing layer which remains on the support-sheet side at that time, a releasing layer which is broken out by aggregation at that time, and other releasing layers. A preferred embodiment of the present invention is an embodiment wherein the releasing layer is non-transferable type and remains on the support-sheet side at the time of the thermal transfer, and the interface between the releasing layer and the thermally transferable protective layer becomes a protective layer surface after the thermal transfer, since the embodiment is excellent in surface gloss, the transfer stability of the protective layer, and others. The method for forming the releasing layer may be a coating method known in the prior art. The releasing layer preferably has a thickness of about 0.5 to 5 μm in the state that the layer is dried.

(Adhesive Layer)

An adhesive layer may be formed, as the topmost layer of the protective layer laminate, on the topmost surface of the protective layer. This makes the adhesive property of the protective layer to a transferred-image-receiving member good.

(Heat Resistant Lubricating Layer)

In the heat-sensitive transfer sheet of the present invention, it is preferred to dispose a heat-resistant lubricating layer on the support at the surface (back side) opposite to the heat-sensitive transfer layer coating side of the support, namely on the same side as the surface with which a thermal head etc. contacts. Further, in the case of a protective layer transfer sheet, it is also preferred to dispose a heat-resistant lubricating layer on the surface (back side) of the support opposite to the transferable protective layer coating side of the support, namely on the same side as the surface with which a thermal head etc. contacts.

If the heat-sensitive transfer sheet is heated by a heating device such as a thermal head in the state such that the back side of the support of the transfer sheet directly contacts with the heating device, heat seal is apt to occur. In addition, owing to a large friction between them, it is difficult to smoothly transfer the heat-sensitive transfer sheet at the time of printing.

The heat-resistant lubricating layer is disposed so as to enable the heat-sensitive transfer sheet to withstand heat energy from a thermal head. The heat-resistant lubricating layer prevents the heat seal, and enables a smooth travel action. Recently, the necessity of the heat-resistant lubricating layer is becoming greater on account that the heat energy from a thermal head is increasing in association with speeding-up of the printer.

The heat-resistant lubricating layer is formed by coating a composition wherein additives such as a sliding agent, a release agent, a surfactant, inorganic particles, organic particles, and pigments are added to a binder. Further, an interlayer may be disposed between the heat-resistant lubricating layer and the support sheet. As the interlayer, there has been known a layer containing inorganic fine particles and a water-soluble resin or a hydrophilic resin capable of emulsification.

As the binder, use can be made of known resins with high heat resistance. Examples of the binder include a single substance or a mixture of natural or synthetic resins including, cellulose series resins such as ethyl cellulose, hydroxycellulose, hydroxypropylcellulose, methyl cellulose, cellulose acetate, cellulose acetate butyrate, cellulose acetate propionate, and nitrocellulose; vinyl series resins such as polyvinyl alcohol, polyvinyl acetate, polyvinyl butyral, polyvinyl acetal, polyvinyl acetoacetal resin, vinyl chloride/vinyl acetate copolymer, and polyvinyl pyrrolidone; acrylic resins such as polymethyl methacrylate, polyethyl acrylate, polyacrylamide, and acrylonitrile/styrene copolymer; polyamide resins, polyimide resins, polyamidoimide resins, polyvinyl toluene resins, cumarone indene resins, polyester-series resins, polyurethane resins, polyether resins, polybutadiene resins, polycarbonate resins, chlorinated polyolefin resins, fluorine resins, epoxy resins, phenolic resins, silicone resins, and silicone-modified or fluorine-modified urethanes.

In order to enhance heat resistance of the heat-resistant lubricating layer, there have been known techniques of cross-linking resins by ultraviolet ray or electron beam radiation. Further, the resin may be cross-linked by heating with a cross-linking agent. According to need, a catalyst may be added to the resin. As an exemplary cross-linking agent, polyisocyanate is known. When the polyisocyanate is used, a resin with a hydroxyl group-based functional group is suited to be cross-linked. JP-A-62-259889 discloses a heat-resistant lubricating layer formed of a reaction product of polyvinyl butyral and an isocyanate compound, to which a bulking agent such as an alkali metal salt or alkaline earth metal salt of phosphoric ester and potassium carbonate is added. JP-A-6-99671 discloses that a heat resistant lubricating layer-forming high molecular compound can be obtained by reacting a silicone compound having an amino group and an isocyanate compound having two or more isocyanate groups in one molecule. In the present invention, these are preferably used.

The heat-resistant lubricating layer may be added with additives such as a sliding agent, a plasticizer, a stabilizer, a bulking agent, and filler for eliminating materials adhered on a head.

Examples of the sliding agent include fluorides such as calcium fluoride, barium fluoride, and graphite fluoride; sulfides such as molybdenum disulfide, tungsten disulfide, and iron sulfide; oxides such as lead oxide, alumina, and molybdenum oxide; solid sliding agents of inorganic compounds such as graphite, mica, boron nitride, and clays (e.g., talc, acid clay); organic resins such as fluorine resins and silicone resins; silicone oil; metal soaps such as metal salt of stearic acid; various kinds of waxes such as polyethylene wax and paraffin wax; and surfactants such as anionic surfactants, cationic surfactants, amphoteric surfactants, nonionic surfactants, and fluorine surfactants.

Also known is a method of using a phosphoric ester-based surfactant such as an alkylphosphoric monoester and a zinc salt of alkylphosphoric diester or a neutralized phosphoric ester-based surfactant, a method of using a neutralizing agent such as magnesium hydroxide and others, and these phosphoric esters are preferably contained in the present invention.

Examples of the other additives include higher fatty acid alcohols, organopolysiloxane, organic carboxylic acids and derivatives thereof, and fine particles of inorganic compounds such as talc and silica.

Among them, use of inorganic particles is particularly preferable.

More specifically, the hardness of the inorganic particles is preferably 3 to 7, more preferably 3 to 6, and still more preferably 3.5 to 5.5, in terms of so-called Mohs' hardness. Inorganic particles having excessively small Mohs' hardness cannot prevent deformation of the ink sheet during high-speed printing, while those having excessively large Mohs' hardness leads to scratching of the thermal printer head.

As the inorganic particles having a Mohs' hardness of 3 to 7, known inorganic particles may be used. Examples thereof include calcium carbonate (Mohs' hardness: 3), dolomite ($MgCa(CO_3)_2$) (Mohs' hardness: 3.5 to 4), magnesium oxide Nohs' hardness: 4), magnesium carbonate (Mohs' hardness: 3.5 to 4.5), and silica (Mohs' hardness: 7). Of these examples, preferable are magnesium oxide and magnesium carbonate, and more preferable is magnesium oxide.

The average particle diameter of the inorganic particles contained in the heat-resistant lubricating layer is preferably 0.3 μm to 5 μm.

In the present invention, particles having excessively small average particle diameter are not effective in preventing deformation of the ink sheet during high-speed printing and also in reducing materials adhering to the thermal printer head, while particles having excessively large average particle diameter leads to rather expanded deformation of the ink sheet during high-speed printing and simultaneously increased abrasion and scratching of the thermal printer head. Scratching and abrasion of the thermal printer head, specifically those of the insulating layer protecting the electrode heat-generating region on the thermal printer head surface, leads to shortened lifetime of the thermal printer head. The average particle diameter is more preferably from 0.3 to 4.5 μm, more preferably from 0.4 to 4 μm. In the invention, the average particle diameter is a value obtained by the laser diffractive scattering method. The spatial distribution of the diffractive scattered light intensities obtained by radiating light to the particles is varied in accordance with the sizes of the particles. Thus, when the spatial distribution of the diffractive scattered light intensities is measured and analyzed, the distribution of the particle sizes can be obtained. Such a technique has been established as the laser diffiractive scattering method. A device used for the measurement may be a commercially available product, such as SALD series (trade name) manufactured by Shimadzu Corp. or LA series (trade name) manufactured by Horiba Ltd.

As for the shape of the inorganic particle, the ratio of the maximum width to the equivalent-sphere diameter is preferably 1.5 to 50. Particles having excessively small ratio are almost not effective in preventing materials adhering to the thermal printer head and occasionally damage the thermal printer head by scratching. Particles having excessively large ratio, for example, spicular inorganic particles having a needle diameter of 0.12 μm and a length of 88 μm which have the ratio of approximately 70, are fragile under external stress and thus, may be hardly contained in the heat-resistant lubricating layer in their original shapes.

The ratio of the maximum width of each of the inorganic particles to the equivalent-sphere diameter thereof can be obtained from an observation of the particles with a scanning electron microscope (SEM). Specific steps therefor are as follows:

1. The inorganic particles are each observed with the SEM while the angle for the observation is varied. The shape, the length, and the thickness thereof are measured.

2. The particle volume is calculated out from the measured shape and size, and then the equivalent-sphere diameter is obtained. The equivalent-sphere diameter is the diameter of a sphere having a volume equal to the calculated-out particle volume. From the measured length and thickness, the maximum width of the particle is obtained. The maximum width of the particle is the maximum value out of lengths between any two points on the particle surface. When the inorganic particle is columnar, the maximum width corresponds to the height of the column. When the inorganic particle is a needle form, the maximum width corresponds to the length of the needle. When the inorganic particle is tabular, the maximum width corresponds to the largest width of the main plane(s).

3. The value of the ratio can be obtained by dividing the maximum width obtained about each of the particles by the equivalent-sphere diameter thereof. When the particle form is spherical, the maximum width and the equivalent-sphere diameter are equal to each other so that the ratio turns one. When the particle form is cubic, the value of the ratio is about 1.4. As the particle form is shifted more largely from a sphere, the value of the ratio becomes larger.

When particles contain therein pores, the volume of the particles cannot be precisely calculated. In this case, however, the ratio is obtained by making calculation on the supposition that the particles have no pores.

The ratio of the maximum width to the equivalent-sphere diameter of the individual inorganic particles contained in the heat-resistant lubricating layer can vary between individual particles. However, preferably 50 mass % or more, more preferably 80 mass % or more, and most preferably 90 mass % or more, of the total mass of all the inorganic particles having Mohs' hardness of 3 to 7 in the heat-resistant lubricating layer have the ratio in the range from 1.5 to 50.

This ratio is more preferably from 1.8 to 45, and further preferably from 2 to 40.

The heat-resistant lubricating layer is formed by adding additives to the binder exemplified above, dissolving or dispersing the resultant into a solvent to prepare a coating liquid, and then applying the coating liquid by a known method such as gravure coating, roll coating, blade coating, or wire bar coating. The film thickness of the heat-resistant lubricating layer is preferably about 0.1 to 10 μm, and more preferably about 0.5 to 5 μm.

(Support)

A polyester film is used as the support (support sheet) of the heat-sensitive transfer sheet of the present invention.

The thickness of the support can be properly determined in accordance with the material of the support so that the mechanical strength, the heat resistance, and the like become optimum. Specifically, it is preferred to use a support having a thickness of 1 μm to 100 μm, more preferably from about 2 μm to 50 μm, and further preferably from about 3 μm to 10 μm.

<<Heat-Sensitive Transfer Image-Receiving Sheet>

The heat-sensitive transfer image-receiving sheet preferably used in the image forming method of the present invention is provided with a receptor layer containing a receptor polymer that receives ink transferred from the heat-sensitive transfer sheet, on the support, and preferably has at least one heat insulating layer between the support and the receptor layer. Further, between the support and the receptor layer, there may be formed an interlayer having various functions such as white back ground controlling, antistatic, adhesion, and leveling functions. Further, a release layer may be formed at the outermost layer on the side to which a heat-sensitive transfer sheet is superposed.

In order to form the heat-sensitive transfer image-receiving sheet to be used in the image forming method of the present invention, a known coating method such as roll coat, bar coat, gravure coat, gravure reverse coat, die coat, slide coat, or curtain coat may be used. Although the layers of the heat-sensitive transfer image-receiving sheet for use in the present invention may be applied one after another separately, it is preferable to form any neighboring layers simultaneously by multilayer coating, and it is most preferable to form all of these layers simultaneously by multilayer coating.

On the side of the support opposite to the receptor layer coating side, a curl adjusting layer, a writing layer, or a static adjusting layer may be disposed.

(Receptor Layer)

<Latex Polymer>

In the present invention, the receptor layer contains a latex polymer.

The latex polymer is generally a dispersion of fine particles of thermoplastic resins in a water-soluble dispersion medium. Examples of the thermoplastic resins used for the latex polymer according to the present invention include polycarbonates, polyesters, polyacrylates, vinyl chloride copolymers, polyurethane, styrene/acrylonitrile copolymers, polycaprolactone and the like.

Among them, polycarbonates, polyesters, and vinyl chloride copolymers are preferable, polyesters and vinyl chloride copolymers are particularly preferable, and vinyl chloride copolymers are most preferable.

The polyester polymers are obtained by condensation of a dicarboxylic acid component (including a derivative thereof) and a diol component (including a derivative thereof). The polyester polymers may contain an aromatic ring and/or an aliphatic ring. The polyester polymers may contain a water-soluble group to promote their dispersion.

The vinyl chloride copolymer is a copolymer that contains a vinyl chloride as essential monomer and is formed by condensation thereof with other monomer. Examples of the vinyl chloride copolymers include vinyl chloride/vinyl acetate copolymers, vinyl chloride/acrylate copolymers, vinyl chloride/methacrylate copolymers, vinyl chloride/vinyl acetate/acrylate copolymers, vinyl chloride/acrylate/ethylene copolymers and the like. As described above, it may be a binary copolymer or a ternary or higher copolymer, and the monomers may be distributed randomly or uniformly by block copolymerization.

The copolymer may contain auxiliary monomer components such as vinylalcohol derivatives, maleic acid derivatives, and vinyl ether derivatives. The copolymer preferably contain vinyl chloride components in an amount of 50 mass % or more, and auxiliary monomer components such as maleic acid derivative and vinyl ether derivative in an amount of 10 mass % or less.

The latex polymers may be used singly or as a mixture. The latex polymer may have a uniform structure or a core/shell structure, and in the latter case, the resins constituting the core and shell respectively may have different glass transition temperatures.

Examples of polyester latex include VYRONAL MD-1100 (Tg 40° C.), VYRONAL MD-1400 (Tg 20° C.), VYRONAL MD-1480 (Tg 20° C.), VYRONAL MD-1985 (Tg 20° C.), VYRONAL MD-1200 (Tg 67° C.), VYRONAL MD-1245 (Tg 61° C.), VYRONAL MD-1500 (Tg 77° C.) (each trade name, manufactured by Toyobo), PLASCOAT Z-850 (Tg 20° C.), PLASCOAT Z-450 (Tg 55° C.), PLASCOAT Z-561 (Tg 64° C.) (each trade name, manufactured by GOO CHEMICAL), ELITEL KZA134 (Tg 40° C.), and ELITEL KA5034 (Tg 67° C.) (each trade name, manufactured by UNITIKA). Examples of vinyl chloride latex copolymer include VINYBLAN 276 (Tg 33° C.), VINYBLAN 609 (Tg 48° C.), VINYBLAN 690 (Tg 46° C.), VINYBLAN 603 (Tg 64° C.), VINYBLAN 900 (Tg 70° C.), VINYBLAN 683 (Tg 72° C.) (each trade name, manufactured by Nisshin Chemical), Sumielite 1320 (Tg 30° C.), and Sumielite 1210 (Tg 20° C.) (each trade name, manufactured by Sumika Chemtex).

<Vinyl Chloride Type Polymer>

The receptor layer according to the present invention is preferably formed of a vinyl chloride type latex polymer. The vinyl chloride type latex polymer is a latex polymer containing repeating units obtained from vinyl chloride, and is preferably a latex polymer containing repeating units obtained from vinyl chloride in an amount of 50% by mass or more.

As the vinyl chloride type latex polymer, a vinyl chloride type latex copolymer is more preferable. The vinyl chloride type latex copolymer is one obtained by using at least vinyl chloride as a monomer used to obtain a latex polymer and by copolymerizing this monomer with other monomers. Examples of the latex copolymer include a vinyl chloride/vinyl acetate copolymer, vinyl chloride/acrylate copolymer, vinyl chloride/methacrylate copolymer, vinyl chloride/vinyl acetate/acrylate copolymer, and vinyl chloride/acrylate/ethylene copolymer. The copolymer may be a binary copolymer or ternary or more copolymer or may be a copolymer in which monomers are distributed at random or may be a block copolymer.

Examples of such a vinyl chloride/vinyl acetate copolymer include SOLBIN C, SOLBIN CL, SOLBIN CH, SOLBIN CN, SOLBIN C5, SOLBIN M, SOLBIN MF, SOLBIN A, SOLBIN AL, SOLBIN TA5R, SOLBIN TAO, SOLBIN MK6, and SOLBIN TA2 (trade names, manufactured by Nissin Chemical Industry Co., Ltd.)

<Water-Soluble Polymer>

In the heat-sensitive transfer image-receiving sheet for use in the image-forming method of the present invention, it is preferable that the receptor layer contains a water-soluble polymer. Herein, the "water-soluble polymer" means a polymer which dissolves, in 100 g of water at 20° C., in an amount of preferably 0.05 g or more, more preferably 0.1 g or more, further preferably 0.5 g or more, and particularly preferably 1 g or more. As the water-soluble polymer, natural polymers, semi-synthetic polymers, and synthetic polymers are preferably used. When these water-soluble polymers are used, each of these polymers is preferably crosslinked by a hardener to be added. To accomplish this crosslinking using the hardener, it is necessary for the water-soluble polymer to be a polymer capable of reacting with the hardener and therefore, the water-soluble polymer has groups (for example, —OH group, >NH group, a group having a —SH group as its partial structure, and a group having the so-called active hydrogen) that react with the double bonds and active halide (releases a halide by a nucleophilic reaction).

Among the water-soluble polymers that can be used in the heat-sensitive transfer image-receiving sheet for use in the image-forming method of the present invention, the natural polymers and the semi-synthetic polymers will be explained in detail. Specific examples include the following polymers: plant type polysaccharides such as κ-carrageenans, ι-carrageenans, λ-carrageenans, and pectins; microbial type polysaccharides such as xanthan gums and dextrins; animal type natural polymers such as gelatins and caseins; and cellulose-based polymers such as carboxymethylcelluloses, hydroxyethylcelluloses, and hydroxypropylcelluloses. Of the natural polymers and the semi-synthetic polymers, gelatin is most preferred.

Gelatin having a molecular weight of 10,000 to 1,000,000 may be used in the present invention. Gelatin that can be used in the present invention may contain an anion such as $Cl^-$ and $SO_4^{2-}$, or alternatively a cation such as $Fe^{2+}$, $Ca^{2+}$, $Mg^{2+}$, $Sn^{2+}$, and $Zn^{2+}$. Gelatin is preferably added as an aqueous solution. Of the water-soluble polymers that can be used in the heat-sensitive transfer image-receiving sheet for use in the image-forming method of the present invention, examples of the synthetic polymers include polyvinyl pyrrolidones, polyvinyl pyrrolidone copolymers, polyvinyl alcohols, polyethylene glycols, polypropylene glycols, and water-soluble polyesters.

As the polyvinyl alcohols, use can be made of various kinds of polyvinyl alcohols such as complete saponification products thereof, partial saponification products thereof, and modified polyvinyl alcohols. With respect to these polyvinyl alcohols, those described in Koichi Nagano et al., "Poval", Kobunshi Kankokai, Inc. are useful.

The viscosity of polyvinyl alcohol can be adjusted or stabilized by adding a trace amount of a solvent or an inorganic salt to an aqueous solution of polyvinyl alcohol, and use may be made of compounds described in the aforementioned reference "Poval", by Koichi Nagano et al., published by Kobunshi Kankokai, pp. 144-154. For a typical example, a coated-surface quality can be improved by an addition of boric acid, and the addition of boric acid is preferable. The amount of boric acid to be added is preferably 0.01 to 40 mass %, with respect to polyvinyl alcohol.

Specific examples of the polyvinyl alcohols include completely saponificated polyvinyl alcohol such as PVA-105, PVA-110, PVA-117 and PVA-117H; partially saponificated polyvinyl alcohol such as PVA-203, PVA-205, PVA-210 and PVA-220; and modified polyvinyl alcohols such as C-118, HL-12E, KL-118 and MP-203 (all of these names are trade names, manufactured by KURARAY CO., LTD.).

<Surfactant>

In the heat-sensitive transfer image-receiving sheet for use in the image-forming method of the present invention, a surfactant may be contained in any of the layers.

In a layer to be added with a surfactant, the addition amount of the surfactant is preferably from 0.01% by mass to 5% by mass, more preferably from 0.01% by mass to 1% by mass, and especially preferably from 0.02% by mass to 0.5% by mass, based on the total solid content.

With respect to the surfactant, various kinds of known surfactants such as anionic, nonionic, cationic, and amphoteric surfactants may be used. For example, it is possible to use surfactants as reviewed in "Kinosei kaimen-kasseizai (Functional Surfactants)", editorial supervision of Mitsuo Tsunoda, edition on August in 2000, Chapter 6. Of these surfactants, anionic and nonionic surfactants are preferred, and further, anionic surfactants are more preferred.

The surfactant may be used singly or in combination of two or more types, and a different surfactant may be used in each layer. At least one of the surfactants to be used is preferably a surfactant containing a fluorine atom.

<Release Agent>

To the heat-sensitive transfer image-receiving sheet for use in the image-forming method of the present invention, a release agent may be added to secure a releasing property between the heat-sensitive transfer sheet and the heat-sensitive transfer image-receiving sheet at the time of image printing.

As the release agent, there can be used, for example, solid waxes such as polyethylene wax, paraffin wax, fatty acid ester wax, and amide wax; and silicone oil, phosphoric ester-based compounds, fluorine-based surfactants, silicone-based surfactants, and other release agents known in this technical field. Of these release agents, preferred are fatty acid ester waxes, fluorine-based surfactants, and silicone-based compounds such as silicone-based surfactants, silicone oil and/or hardened products thereof.

The heat-sensitive transfer image-receiving sheet that can be used in the image-forming method of the present invention preferably contains a polymer having fluorine atom-substituted aliphatic groups on the side chains in the receptor layer.

The polymer having fluorine atom-substituted aliphatic groups on the side chains can be derived from a fluorine atom-substituted aliphatic compound (compound having fluorine atom-substituted aliphatic group(s) on the side chain(s)) produced by a telomerization method (also referred to as a telomer method), or an oligomerization method (also referred to as an oligomer method). The fluorine atom-substituted aliphatic compound can be easily synthesized, for example, by a method described in JP-A-2002-90991.

The fluorine atom-substituted aliphatic group is an aliphatic group having at least one fluorine atom substituted thereon (straight-chain, branched or cyclic aliphatic group), preferably an alkyl, alkenyl, or cycloalkynyl group having 1 to 36 carbon atoms, more preferably an alkyl group having 1 to 36 carbon atoms (preferably 1 to 18 carbon atoms, more preferably 1 to 12 carbon atoms, furthermore preferably 1 to 10 carbon atoms, most preferably 4 to 8 carbon atoms), and the aliphatic group may be substituted additionally with groups other than fluorine atom. Examples of the substituent groups include alkyl groups, aryl groups, heterocyclic groups, halogen atoms other than fluorine atom, a hydroxyl group, alkoxy groups, aryloxy groups, alkylthio groups, arylthio groups, an amino group, alkylamino groups, arylamino groups, heterocyclic amino groups, acylamino groups, sulfone amino groups, carbamoyl groups, sulfamoyl groups, a cyano group, a nitro group, acyl groups, sulfonyl groups, ureido groups, urethane groups and the like.

In the present invention, the fluorine atom-substituted aliphatic group is most preferably a perfluoroalkyl group.

The polymer having fluorine atom-substituted aliphatic groups on the side chains is preferably a polymer or copolymer of a monomer having a fluorine atom-substituted aliphatic group. Examples of the preferable monomers thereof include acrylic acid derivatives (e.g., acrylic acids, acrylic esters, and acrylamides, preferably acrylic esters and acrylamides, more preferably acrylic esters) and methacrylic acid derivatives (e.g., methacrylic acids, methacrylic esters, and methacrylamides, preferably methacrylic esters and methacrylamides, more preferably methacrylic esters), having an acyl, alcohol or amido group (substituent group on nitrogen atom) substituted with a fluorine atom-substituted aliphatic group; and acrylonitrile derivatives having a fluorine atom-substituted aliphatic group.

In the case where the polymer having fluorine atom-substituted aliphatic groups on the side chains is a copolymer of a fluorine atom-substituted aliphatic group-containing monomer and another monomer, examples of the monomer to be used in combination with include acrylates, methacrylates, acrylonitriles, acrylamides, methacrylamides, olefins, styrenes, and the like. Among them, acrylates, methacrylates, acrylonitriles, acrylamides, and methacrylamides are preferable, and acrylates and methacrylates are more preferable. Among them, those having a polyoxyalkylene (e.g., polyoxyethylene, polyoxypropylene) unit in the group substituted on the alcohol group or the amide nitrogen atom are preferable.

In the present invention, the polymer above is preferably a copolymer, which may be a binary copolymer or a ternary or higher copolymer.

As the polymers having a fluorine atom-substituted aliphatic group on the side chains, preferred are copolymers of a monomer having a fluorine atom-substituted aliphatic group and (poly(oxyalkylene))acrylate and/or (poly(oxyalkylene))methacrylate. They may be distributed randomly, or block copolymerized. Examples of the poly(oxyalkylene) group include poly(oxyethylene) group, poly(oxypropylene) group, and poly(oxybutylene) group. Further, the poly(oxyalkylene) group may be a unit having alkylene groups of chain lengths different from each other in the same chain, such as poly(block connecter of oxyethylene, oxypropylene and oxyethylene) and poly(block connecter of oxyethylene and oxypropylene). Further, the copolymer of a monomer having a fluorine atom-substituted aliphatic group and (poly(oxyalkylene))acrylate (or methacrylate) is not limited to binary copolymers, but may be ternary or higher copolymers that can be produced by copolymerizing, at the same time, several different monomers such as two or more different kinds of monomers having fluorine atom-substituted aliphatic groups and two or more different kinds of (poly(oxyalkylene))acrylate (or methacrylate).

The mass-average molecular weight of the polymers having a fluorine atom-substituted aliphatic group at the side chain ranges preferably from 5,000 to 50,000, more preferably from 8,000 to 30,000, and further preferably from 10,000 to 20,000.

Examples thereof include copolymers of acrylate (or methacrylate) having a perfluorobutyl group ($—C_4F_9$) and (poly(oxyalkylene))acrylate (or methacrylate); copolymers of acrylate (or methacrylate) having a perfluorobutyl group, (poly(oxyethylene))acrylate (or methacrylate), and (poly(oxypropylene))acrylate (or methacrylate); copolymers of acrylate (or methacrylate) having a perfluorohexyl group ($—C_6F_{13}$) and (poly(oxyalkylene))acrylate (or methacrylate); copolymers of acrylate (or methacrylate) having a perfluorohexyl group, (poly(oxyethylene))acrylate (or methacrylate), and (poly(oxypropylene))acrylate (or methacrylate); copolymers of acrylate (or methacrylate) having a perfluorooctyl group ($—C_8F_{17}$) and poly(oxyalkylene))acrylate (or methacrylate); and copolymers of acrylate (or methacrylate) having a perfluorooctyl group, (poly(oxyethylene))acrylate (or methacrylate), and (poly(oxypropylene))acrylate (or methacrylate).

Further, the polymers having a fluorine atom-substituted aliphatic group on the side chains for use in the heat-sensitive transfer image-receiving sheet for use in the image-forming method of the present invention are commercially available under a general name such as "perfluoroalkyl-containing oligomers". For example, the following products can be used.

As the products of Dainippon Ink & Chemicals Incorporated, there are Megafac F-470, Megafac F-471, Megafac F-472SF, Megafac F-474, Megafac F-475, Megafac F-477, Megafac F-478, Megafac F-479, Megafac F-480SF, Megafac F-472, Megafac F-483, Megafac F-484, Megafac F-486, Megafac F-487, Megafac F-489, Megafac F-172D, Megafac F-178K, Megafac F-178RM (eachtrade name). As the products of Sumitomo 3M Limited, there are Novec™ FC-4430 and FC-4432 (each trade name).

The polymer having fluorine atom-substituted aliphatic groups on the side chains is preferably nonionic (having no dissociable group in water such as sulfo or carboxyl group), and more preferably, it is water-soluble to a certain degree. The phrase "water soluble to a certain degree" means that the polymer has solubility of 1% or more to pure water of at 25° C. Specifically, the polymer is, for example, a polymer having hydroxyl groups or the oxyalkylene groups described above, and favorable examples thereof include water-soluble compounds such as Megafac F-470, Megafac F-472SF, Megafac F-477, Megafac F-479, Megafac F-480SF, Megafac F-484, and Megafac F-486 (all trade names, manufactured by Dainippon Ink and Chemicals, Inc.).

The reason why, in the heat-sensitive transfer image-receiving sheet for use in the image-forming method of the present invention, the polymer having fluorine atom-substituted aliphatic groups on the side chains being nonionic and soluble in water to a certain degree exhibits preferred effects is not yet to be understood, but it is assumed as follows: The nonionic polymer having fluorine atom-substituted aliphatic groups on the side chains has high affinity for the dye thermally transferred and the receptor polymer; and the nonionic polymer also has suitable affinity, because of its water solubility, for the receiving layer of the heat-sensitive transfer image-receiving sheet in which layer a latex is used, and thus the nonionic polymer leaches out to the interface between the heat-sensitive transfer sheet and the heat-sensitive transfer image-receiving sheet during printing under a high-temperature and high-humidity condition, thereby it shows effective releasing action.

The addition amount of the polymer having fluorine atom-substituted aliphatic groups on the side chains is preferably 0.2% to 10%, more preferably 0.5% to 8%, and still more preferably 1% to 5%, with respect to the total solid content (mass) in the receptor layer. Also, though the high-molecular compounds having an aliphatic group substituted with a fluorine atom on its side chain produce their effects even if any of them is added singly, a higher effect is obtained by adding two or more of these high-molecular, compounds.

<Matting Agent>

To the heat-sensitive transfer image-receiving sheet for use in the image-forming method of the present invention, a matting agent may be added in order to prevent blocking, or to give a release property or a sliding property. The matting agent may be added to the heat-sensitive transfer image-receiving sheet, on the same side as the coating side of the receptor layer, or on the side opposite to the coating side of the receptor layer, or on both sides.

Examples of the matting agent generally include fine particles of water-insoluble organic compounds and fine particles of water-insoluble inorganic compounds. In the present invention, the organic compound-containing fine particles are preferably used from the viewpoints of dispersion properties. Herein, it is sufficient if an organic compound is incorporated in the organic compound-containing fine particles, and thus the organic compound-containing fine particles can be organic compound fine particles consisting of the organic compound alone, or alternatively organic/inorganic composite fine particles containing not only the organic compound but also an inorganic compound. As the matting agent, there can be used organic matting agents described in, for example, U.S. Pat. Nos. 1,939,213, 2,701,245, 2,322,037, 3,262,782, 3,539,344, and 3,767,448.

<Antiseptic>

To the heat-sensitive transfer image-receiving sheet for use in the image-forming method of the present invention, antiseptics may be added. The antiseptics that may be used in the image-receiving sheet for use in the present invention are not particularly limited. For example, use can be made of materials described in "Bofubobai Handbook (Preservation and Antiftngi Handbook)", Gihodo shuppan (1986), "Bokin Bobai no Kagaku (Chemistry of Anti-bacteria and Anti-fungi)" authored by Hiroshi Horiguchi, Sankyo Shuppan (1986), "Bokin/Bobai-zai Jiten (Encyclopedia of Antibacterial and Antifungal Agent)" edited by The Society for Antibacterial and Antifungal Agents, Japan (1986). Examples thereof include imidazole derivatives, sodium dehydroacetate, 4-isothiazoline-3-one derivatives, benzoisothiazoline-3-one, benzotriazole derivatives, amidineguanidine derivatives, quaternary ammonium salts, pyrrolidine, quinoline, guanidine derivatives, diazine, triazole derivatives, oxazole, oxazine derivatives, and 2-mercaptopyridine-N-oxide or its salt. Of these antiseptics, 4-isothiazoline-3-one derivatives and benzoisothiazoline-3-one are preferred.

In the present invention, the amount of the receptor layer to be applied is preferably 0.5 to 10 g/m$^2$ (solid basis, hereinafter, the amount to be applied in the present specification is a value on solid basis unless otherwise noted). The thickness of the receptor layer is preferably 1 to 20 μm.

The receptor layer may contain a ultraviolet absorber, a lubricant, an antioxidant, and the like, besides the above ingredients.

<Heat Insulation Layer>

The heat insulation layer that is coated in the heat-sensitive transfer image-receiving sheet for use in the present invention may be a single layer or two or more layers. It is preferred that the heat insulation layer be provided between the receptor layer and the support, and it is particularly preferred that the heat insulation layer contain hollow polymer particles.

The hollow polymer is a polymer particle having independent voids inside of the particle and it is preferably a latex polymer. Examples of the hollow polymer particles include (1) non-foaming type hollow polymer particles obtained in the following manner: water is contained inside of a capsule wall formed of a polystyrene, acrylic resin, or styrene/acrylic resin, and the like; and, after a coating liquid is applied and dried, the water in the particles is vaporized out of the particles, with the result that the inside of each particle forms a hollow; (2) foaming type microballoons obtained in the following manner: a low-boiling-point liquid such as butane and pentane, is encapsulated in a resin constituted of any one of polyvinylidene chloride, polyacrylonitrile, polyacrylic acid, and polyacrylate, or their mixture or polymer, and after the resin coating material is applied, it is heated to expand the low-boiling-point liquid inside of the particles, whereby the inside of each particle is made to be hollow; and (3) microballoons obtained by foaming the above (2) under heating in advance, to make hollow polymer particles.

As the hollow polymer particles, the non-foaming hollow polymer particles of the foregoing (1) are preferred. If necessary, use can be made of a mixture of two or more kinds of the polymer particles. Specific examples of the above (1) include Rohpake HP-1055, manufactured by Rohm and Haas Co.; SX866(B), manufactured by JSR Corporation; and Nipol MH5055, manufactured by ZEON CORPORATION (all of these product names are trade names).

The solid content by mass of the hollow polymer particles contained in the heat insulation layer is preferably in the range of 70% to 95%, and more preferably from 75% to 90% of the total solid content by mass of the receptor layer.

The average particle diameter of the hollow polymer particles contained in the heat insulation layer is preferably in the range of 0.1 μm to 3.0 μm, more preferably from 0.2 μm to 2.0 μm, furthermore preferably from 0.3 μm to 0.8 μm.

In the present invention, the particle diameter of the hollow polymer particles is calculated after measurement of the equivalent-circle diameter of the periphery of the particles under a transmission electron microscope. The average particle diameter is determined by measuring the equivalent-circle diameter of the periphery of at least 300 hollow polymer particles observed under the transmission electron microscope and obtaining the average thereof.

The hollow (void) ratio of the hollow polymer particles is calculated by the ratio of the volume of voids to the volume of a particle.

It is preferred that the heat insulation layer contains a water-soluble polymer as a binder in addition to hollow polymer particles. A preferable water-soluble polymer is exemplified by water-soluble polymers described in the section of Receptor layer. Among these water-soluble polymers, gelatin and a polyvinyl alcohol are more preferable. These resins may be used either singly or as a mixture thereof.

The thickness of the heat insulation layer containing the hollow polymer particles is preferably from 5 to 50 μm, more preferably from 5 to 40 μm.

To the heat insulation layer, the aforementioned water-soluble polymers that can be added to the receptor layer may be added. The same water-soluble polymers as or different water-soluble polymers from those of the receptor layer may be used in the heat insulation layer. These water-soluble polymers may be used in any combination and any proportion. As the water-soluble polymer used in the heat-insulation layer, polyvinyl alcohol or gelatin is preferable, and gelatin is most preferable.

The solid content by mass of the water-soluble polymer contained in the heat insulation layer is preferably in the range of 2% to 50%, more preferably from 5% to 30%, and further more preferably from 10% to 20%, of the total solid content by mass of the heat insulation layer.

(Intermediate Layer)

Further, aside form the aforementioned heat insulation layer, there may be formed an intermediate layer having various functions such as white back ground controlling, anti-static, adhesion, and leveling functions, between the support and the receptor layer. The function of the intermediate layer is not limited to these, and a previously known intermediate layer may be provided. In the heat-sensitive transfer image-receiving sheet for use in the image-forming method of the present invention, it is preferable that at least one intermediate layer is formed between the support and the heat insulation layer nearest to the support.

It is preferable that such an intermediate layer contains a latex polymer. The glass transition temperature (Tg) of the latex polymer is preferably in the range of −40° C. to 40° C., more preferably from −30° C. to 30° C., and furthermore preferably from −20° C. to 20° C.

In the heat-sensitive transfer image-receiving sheet for use in the image-forming method of the present invention, examples of preferable latex polymer include acrylic latex, polyester-based latex, styrenelbutadiene-based latex, methylmethacrylate/butadiene-based latex, polyurethane-based latex, and vinyl chloride-based latex. These latex polymers may be straight-chain, branched, or cross-linked polymers, and they may be the so-called homopolymers obtained by polymerizing single type of monomers, or copolymers obtained by polymerizing two or more types of monomers. In the case of the copolymers, these copolymers may be either random copolymers or block copolymers. The molecular weight of each of these polymers is preferably 5,000 to 1,000,000, and further preferably 10,000 to 500,000 in terms of number-average molecular weight.

Of these, styrene/butadiene-based latex, methylmethacrylate/butadiene-based latex, and polyurethane-based latex are preferable. Methylmethacrylate/butadiene-based latex and polyurethane-based latex are especially preferable.

Specific examples of the styrene/butadiene-based latex include Nipol LX421, Nipol LX430, Nipol LX435, and Nipol LX438C (each trade name, manufactured by Nippon Zeon), SR-103, SR-104, SR-108, SR-140, and SR-141 (each trade name, manufactured by Nippon A&L Inc.).

Specific examples of the methylmethacrylate/butadiene-based latex include MR-170, MR-171, MR-173, and MR-180 (each trade name, manufactured by NipponA & L Inc.).

Specific examples of the polyurethane-based latex include HYDRAN AP-10, AP-20, AP-30, and AP-40 (each trade name, manufactured by Dainippon Ink & Chemicals Inc.), WBR-016U, WBR-2018, WBR-2019 (each trade name, manufactured by Taisei Fine Chemical), and NS-310X (trade name, manufactured by TAKAMATSU OIL & FAT).

<Curl Adjusting Layer>

In the heat-sensitive transfer image-receiving sheet for use in the image-forming method of the present invention, a curl adjusting layer is preferably formed according to need. For the curl adjusting layer, for example, a polyethylene laminate and a polypropylene laminate may be used. Specifically, the curl adjusting layer may be formed in the same manner as described in, for example, JP-A-61-110135 and JP-A-6-202295.

<Writing Layer and Charge Controlling Layer>

In the heat-sensitive transfer image-receiving for use in the image-forming method of the present invention, if necessary, a writing layer or a charge controlling layer may be disposed. For the writing layer and the charge control layer, an inorganic oxide colloid, an ionic polymer, or the like may be used. As the antistatic agent, any antistatic agents including cationic antistatic agents such as a quaternary ammonium salt and polyamine derivative, anionic antistatic agents such as alkyl phosphate, and nonionic antistatic agents such as fatty acid ester may be used. Specifically, the writing layer and the charge control layer may be formed in a manner similar to those described in the specification of Japanese Patent No. 3,585,585.

<Support>

As the support that is used for the heat-sensitive transfer image-receiving sheet for use in the image-forming method of the present invention, use can be made of previously known supports with a preferable example being a water-proof support. The use of the waterproof support makes it possible to prevent the support from absorbing moisture, whereby a fluctuation in the performance of the receptor layer with the lapse of time can be prevented. As the waterproof support, for example, coated paper, laminate paper or synthetic paper may be used. Among them, laminate paper is preferable.

<<Image-Forming Method (System)>>

In the image-forming method (system) of the present invention, imaging is achieved by superposing a heat-sensitive transfer sheet on a heat-sensitive transfer image-receiving sheet so that a heat-sensitive transfer layer of the heat-sensitive transfer sheet is in contact with a receptor layer of the heat-sensitive transfer image-receiving sheet, and giving thermal energy in accordance with image signals given from a thermal head.

Specifically, an image-forming may be conducted in a similar manner as described in, for example, JP-A-2005-88545. In the present invention, a printing time is preferably less than 15 seconds, more preferably in the range of 3 to 12 seconds, and further preferably 3 to 7 seconds, from the viewpoint of shortening the time taken until a consumer gets a print.

In order to accomplish the above-described printing time, a line speed at the time of printing is preferably 1.0 msec/line or less, more preferably 0.8 msec/line or less, and further more preferably 0.7 msec/line or less. Further, from the viewpoint of improvement in transfer efficiency as one of speeding-up conditions, the maximum ultimate temperature of the thermal head at the time of printing is preferably in the range of 180° C. or higher and 450° C. or lower, more preferably 200° C. or higher and 450° C. or lower, and furthermore preferably 350° C. or higher and 450° C. or lower.

The present invention may be utilized in, for example, printers and copying machines utilizing the heat-sensitive transfer recording system. As the heat energy imparting means in the heat transfer operation, any of the conventionally known imparting means may be used. The desired effect can be satisfactorily attained by a recording device such as a thermal printer (for example, ASK-2000 (trade name), manufactured by FUJIFILM Corporation).

The heat-sensitive transfer image-receiving sheet and image-forming method according to the present invention is excellent in maximum transfer density, is resistant to irregular transfer, is excellent in maximum transfer density, is excellent in the light fastness for a printed product after the image transfer, is free from defects such as cutting and wrinkles of the heat-sensitive transfer sheet in the transferring operation, and is also reduced in gloss unevenness of the printed product after the transferring of a protective layer.

The present invention will be described in more detail based on the following examples, but the invention is not intended to be limited thereto.

EXAMPLES

Example 1

(Preparation of Heat-Sensitive Transfer Sheet)

Heat-sensitive transfer sheet 101 was prepared as follows.

A polyester film 4.5 μm in thickness (trade name: Lumirror 5A-F595, manufactured by TORAY INDUSTRIES, INC.), that was subjected to an easy-adhesion-treatment on one surface of the film, was used as a support. The following back side-layer coating liquid was applied onto the support on the other surface that was not subjected to the easy-adhesion-treatment, so that the coating amount based on the solid content after drying would be 1 g/m$^2$. After drying, the coating liquid was cured by heat at 50° C.

Using the following coating solutions, a barrier layer 1 and a thermal-transfer layer 1 were applied in this order on the easy-adhesion layer coating side of the polyester film formed in the above manner, to produce a heat-sensitive transfer sheet 101.

Back Side Layer-Coating Liquid

| | |
|---|---|
| Acrylic polyol resin (trade name: ACRYDIC A-801, manufactured by Dainippon Ink and Chemicals, Incorporated) | 17.3 mass parts |
| Zinc stearate (trade name: SZ-2000, manufactured by Sakai Chemical Industry Co., Ltd.) | 0.26 mass parts |
| Phosphoric ester (trade name: Phoslex A18, manufactured by Sakai Chemical Industry Co., Ltd.) | 0.52 mass parts |
| Phosphoric ester (trade name: PLYSURF-A217, manufactured by Dai-ichi Kogyo Seiyaku Co., Ltd.) | 3.59 mass parts |
| Talc (trade name: MICRO ACE L-1, manufactured by NIPPON TALC Co., Ltd.) | 0.52 mass parts |
| Magnesium oxide (trade name: STARMAG PSF, manufactured by Konoshima Chemical Co., Ltd.) | 0.07 mass parts |
| Polyisocyanate (trade name: BURNOCK D-750, manufactured by Dainippon Ink and Chemicals, Incorporated) | 7.77 mass parts |
| Methyl ethyl ketone/Toluene (2/1, at mass ratio) | 70 mass parts |

Barrier Layer 1-Coating Liquid (a Layer According to That Described in the Publication of JP-B-7-102746)

| | |
|---|---|
| Polyvinylpyrrolidone (trade name: K-90, manufactured by ISP Japan Ltd.) | 3.8 mass parts |
| Polyvinyl alcohol (trade name: PVA-203, manufactured by KURARAY CO., LTD.) | 1.2 mass parts |
| Water/Methanol (1/1, at mass ratio) | 95 mass parts |
| Solid content coated | 0.11 g/m$^2$ |

Thermal Transfer Layer 1-Coating Liquid

| | |
|---|---|
| Dye C1-1 | 7.0 mass parts |
| Polyvinylacetal resin (trade name: DENKA BUTYRAL #5000-D, manufactured by DENKI KAGAKU KOGYO K.K.) | 7.5 mass parts |
| Methyl ethyl ketone/Toluene (2/1, at mass ratio) | 85 mass parts |

Releasing-Layer-Coating Liquid

| | |
|---|---|
| Modified cellulose resin (trade name: L-30, manufactured by DAICEL CHEMICAL INDUSTRIES, LTD.) | 5.0 mass parts |
| Methyl ethyl ketone | 95.0 mass parts |

Protective-Layer-Coating Liquid

| | |
|---|---|
| Acrylic resin (trade name: DIANAL BR-100, manufactured by MITSUBISHI RAYON CO., LTD.) | 35 mass parts |
| Isopropanol | 75 mass parts |

Adhesive-Layer-Coating Liquid

| | |
|---|---|
| Acrylic resin (trade name: DIANAL BR-77, manufactured by MITSUBISHI RAYON CO., LTD.) | 25 mass parts |
| Ultraviolet absorbent UV-1 | 1.5 mass parts |
| Ultraviolet absorbent UV-2 | 1.5 mass parts |
| Ultraviolet absorbent UV-3 | 1.2 mass parts |
| Ultraviolet absorbent UV-4 | 0.8 mass parts |
| Silicone resin fine particles (trade name: TOSPEARL 120, manufactured by MOMENTIVE Performance Materials Japan LLC.) | 0.06 mass parts |
| Methyl ethyl ketone/toluene (2/1, at mass ratio) | 70 mass parts |

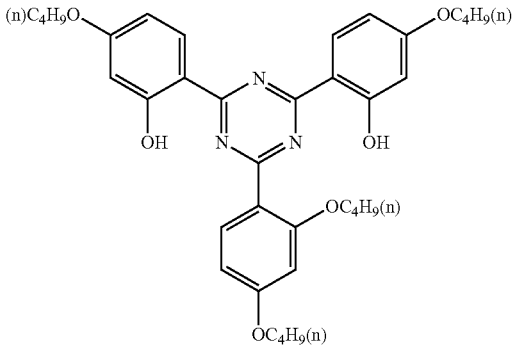

(UV-1)

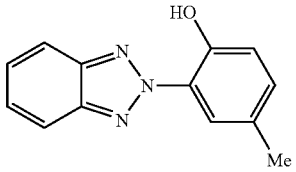

(UV-2)

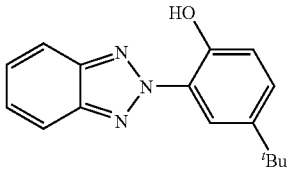

(UV-3)

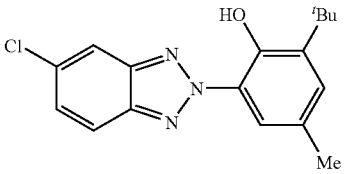

(UV-4)

Transferable Protective Layer Laminate

On the same polyester film as used in the preparation of the heat-sensitive transfer layer as described above, coating liquids of a releasing layer, a protective layer, and an adhesive layer, each having the following composition, were coated, to form a transferable protective layer laminate. Coating amounts of the releasing layer, the protective layer, and the adhesive layer, after drying were 0.5 g/m$^2$, 1.0 g/m$^2$, and 1.8 g/m$^2$, respectively.

Heat-sensitive transfer image-receiving sheet 102 was prepared in the same manner as the heat-sensitive transfer image-receiving sheet 101, except that the barrier layer 1-coating liquid was changed to the following barrier layer 2-coating liquid.

Barrier Layer 2-Coating Liquid (Barrier Layer Described in JP-A-2005-231354)

| | |
|---|---|
| Polyvinylpyrrolidone (trade name: K-90, manufactured by ISP Japan Ltd.) | 5 mass parts |

-continued

| | |
|---|---|
| Modified polyvinylpyrrolidone (trade name: ANTARA430, manufactured by ISP Japan Ltd.) | 5 mass parts |
| Methyl ethyl ketone/Isopropanol (1/1, at mass ratio) | 186 mass parts |
| Solid content coated | 0.06 $g/m^2$ |

Heat-sensitive transfer image-receiving sheet 103 was prepared in the same manner as the heat-sensitive transfer image-receiving sheet 101, except that the barrier layer 1-coating liquid was changed to the following barrier layer 3-coating liquid.

Barrier Layer 3-Coating Liquid

| | |
|---|---|
| Polyvinylpyrrolidone (trade name: K-90, manufactured by ISP Japan Ltd.) | 4 mass parts |
| Modified polyvinylpyrrolidone (trade name: ANTARA430, manufactured by ISP Japan Ltd.) | 4 mass parts |
| Titanium tetranormalbutoxide (manufactured by Wako Pure Chemical Industries, Ltd.) | 2 mass parts |
| Methyl ethyl ketone/Isopropanol (1/1, at mass ratio) | 186 mass parts |
| Solid content coated | 0.06 $g/m^2$ |

Heat-sensitive transfer image-receiving sheet 104 was prepared in the same manner as the heat-sensitive transfer image-receiving sheet 101, except that the barrier layer 1-coating liquid was changed to the following barrier liquid 4-coating liquid.

Barrier Layer 4-Coating Liquid

| | |
|---|---|
| Polyvinylpyrrolidone (trade name: K-90, manufactured by ISP Japan Ltd.) | 3 mass parts |
| Modified polyvinylpyrrolidone (trade name: ANTARA430, manufactured by ISP Japan Ltd.) | 3 mass parts |
| Colloidal alumina (trade name: ALUMINASOL 100, manufactured by Nissan Chemical Industries, Ltd.) | 4 mass parts |
| Methyl ethyl ketone/Isopropanol (1/1, at mass ratio) | 186 mass parts |
| Solid content coated | 0.06 $g/m^2$ |

Heat-sensitive transfer image-receiving sheet 105 was prepared in the same manner as the heat-sensitive transfer image-receiving sheet 101, except that the thermal transfer layer 1-coating liquid was changed to the following thermal transfer layer 2-coating liquid.

Thermal Transfer Layer 2-Coating Liquid

| | |
|---|---|
| Dye represented by C1-1 | 7.0 mass parts |
| Polyvinylacetal resin (trade name: DENKA BUTYRAL #5000-D, manufactured by DENKI KAGAKU KOGYO K.K.) | 7.5 mass parts |
| Silicone oil (trade name: KF-354L, manufactured by Shin-Etsu Chemical Co., Ltd.) | 0.02 mass parts |
| Methyl ethyl ketone/Toluene (2/1, at mass ratio) | 85 mass parts |
| Solid content coated | 0.8 $g/m^2$ |

Heat-sensitive transfer image-receiving sheet 106 was prepared in the same manner as the heat-sensitive transfer image-receiving sheet 101, except that the thermal transfer layer 1-coating liquid was changed to the following thermal transfer layer 3-coating liquid.

Thermal Transfer Layer 3-Coating Liquid

| | |
|---|---|
| Dye C1-1 | 7.0 mass parts |
| Polyvinylacetal resin (trade name: DENKA BUTYRAL #5000-D, manufactured by DENKI KAGAKU KOGYO K.K.) | 7.5 mass parts |
| Silicone oil (trade name: KF-642, manufactured by Shin-Etsu Chemical Co., Ltd.) | 0.02 mass parts |
| Methyl ethyl ketone/Toluene (2/1, at mass ratio) | 85 mass parts |
| Solid content coated | 0.8 $g/m^2$ |

Heat-sensitive transfer image-receiving sheet 107 was prepared in the same manner as the heat-sensitive transfer image-receiving sheet 101, except that the thermal transfer layer 1-coating liquid was changed to the following thermal transfer layer 4-coating liquid.

Thermal Transfer Layer 4-Coating Liquid

| | |
|---|---|
| Dye C1-3 | 7.0 mass parts |
| Polyvinylacetal resin (trade name: DENKA BUTYRAL #5000-D, manufactured by DENKI KAGAKU KOGYO K.K.) | 7.5 mass parts |
| Amino-modified silicone (tradename: KF-393, manufactured by Shin-Etsu Chemical Co., Ltd.) | 0.01 mass parts |
| Epoxy-modified silicone (tradename: X-22-343, manufactured by Shin-Etsu Chemical Co., Ltd.) | 0.01 mass parts |
| Methyl ethyl ketone/Toluene (2/1, at mass ratio) Solid content coated | 85 mass parts<br>0.8 $g/m^2$ |

Heat-sensitive transfer image-receiving sheet 108 was prepared in the same manner as the heat-sensitive transfer image-receiving sheet 103, except that the thermal transfer layer 1-coating liquid was changed to the thermal transfer layer 2-coating liquid.

Heat-sensitive transfer image-receiving sheet 109 was prepared in the same manner as the heat-sensitive transfer image-receiving sheet 104, except that the thermal transfer layer 1-coating liquid was changed to the thermal transfer layer 3-coating liquid.

Heat-sensitive transfer image-receiving sheet 110 was prepared in the same manner as the heat-sensitive transfer image-receiving sheet 105, except that the thermal transfer layer 1-coating liquid was changed to the following thermal transfer layer 5-coating liquid.

Thermal Transfer Layer 5-Coating Liquid

| | |
|---|---|
| C.I. Solvent Blue 63 (dye described in JP-A-9-202058) | 7.0 mass parts |
| Polyvinylacetal resin (trade name: DENKA BUTYRAL #5000-D, manufactured by DENKI KAGAKU KOGYO K.K.) | 7.5 mass parts |
| Silicone oil (trade name: KF-354L, manufactured by Shin-Etsu Chemical Co., Ltd.) | 0.02 mass parts |
| Methyl ethyl ketone/Toluene (2/1, at mass ratio) | 85 mass parts |
| Solid content coated | 0.8 $g/m^2$ |

Heat-sensitive transfer image-receiving sheet 111 was prepared in the same manner as the heat-sensitive transfer image-receiving sheet 110, except that the dye was changed to C. I. Solvent Blue 22 (dye described in JP-A-2005-231354).

Heat-sensitive transfer image-receiving sheet 112 was prepared in the same manner as the heat-sensitive transfer image-receiving sheet 110, except that the dye was changed to the following dye A.

Dye A

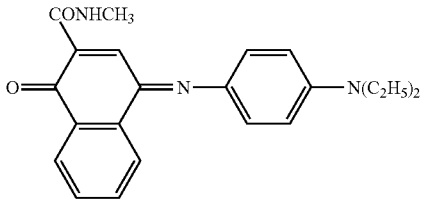

(dye described in JP-B-7-102746)

Heat-sensitive transfer image-receiving sheet 113 was prepared in the same manner as the heat-sensitive transfer image-receiving sheet 101, except that the thermal transfer layer 1-coating liquid was changed to the following thermal transfer layer 6-coating liquid.

Thermal Transfer Layer 6-Coating Liquid

| | |
|---|---|
| The following dye B | 7.0 mass parts |
| Polyvinylacetal resin (trade name: DENKA BUTYRAL #5000-D, manufactured by DENKI KAGAKU KOGYO K.K.) | 7.5 mass parts |
| Silicone oil (trade name: KF-354L, manufactured by Shin-Etsu Chemical Co., Ltd.) | 0.02 mass parts |
| Methyl ethyl ketone/Toluene (2/1, at mass ratio) | 85 mass parts |
| Solid content coated | 0.8 g/m$^2$ |

Dye B

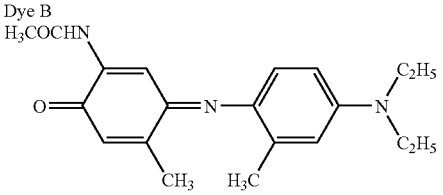

Heat-sensitive transfer image-receiving sheet 114 was prepared in the same manner as the heat-sensitive transfer image-receiving sheet 101, except that the barrier layer was not provided.

Heat-sensitive transfer image-receiving sheet 115 was prepared in the same manner as the heat-sensitive transfer image-receiving sheet 101, except that the barrier layer 1-coating liquid was changed to the following barrier layer 5-coating liquid.

Barrier Layer 5-Coating Liquid

| | |
|---|---|
| Polyvinylpyrrolidone (trade name: K-90, manufactured by ISP Japan Ltd.) | 10 mass parts |
| Methyl ethyl ketone/Isopropanol (1/1, at mass ratio) | 186 mass parts |
| Solid content coated | 0.06 g/m$^2$ |

(Preparation of Heat-Sensitive Transfer Image-Receiving Sheet 201)

A paper support, on both sides of which polyethylene was laminated, was subjected to corona discharge treatment on the surface thereof, and then a gelatin undercoat layer containing sodium dodecylbenzenesulfonate was disposed on the treated surface. A subbing layer, a heat insulation layer, and a receptor layer, having the following compositions respectively were simultaneously multilayer-coated on the gelatin undercoat layer, in the state that the subbing layer, the heat insulation layer, and the receptor layer were laminated in this order from the side of the support, by a method illustrated in FIG. 9 in U.S. Pat. No. 2,761,791. The coating was performed so that the coating amounts of the subbing layer, the heat insulation layer, and the receptor layer, after drying, would be 6.6 g/m$^2$, 8.8 g/m$^2$, and 5.0 g/m$^2$, respectively. Also, in the following compositions, the content of each component is a solid content by mass. Also, the percentage (%) showing the proportion of the vinyl chloride monomer is a percent (%) by mass.

<Subbing Layer-Coating Liquid>

| | |
|---|---|
| Styrene butadiene latex (trade name: SR103, manufactured by NIPPON A & L INC.) | 60 mass parts |
| PVA (6% aqueous solution) (trade name: POVAL PVA 205, manufactured by Kuraray) | 40 mass parts |
| NaOH aqueous solution | amount necessary for adjusting pH to 8 |

<Heat Insulation Layer-Coating Liquid>

| | |
|---|---|
| Hollow latex polymer (trade name: MH5055, manufactured by Nippon Zeon Co., Ltd.) | 60 mass parts |
| Gelatin (10% aqueous solution) | 20 mass parts |
| NaOH aqueous solution | amount necessary for adjusting pH to 8 |

<Receptor Layer-Coating Liquid>

| | |
|---|---|
| Vinyl chloride-series latex (trade name: VINYBLAN 900, manufactured by Nisshin Chemicals Co., Ltd., Tg: 70° C., vinyl chloride unit rate: 90%) | 49 mass parts |
| Vinyl chloride-series latex (trade name: VINYBLAN 609, manufactured by Nisshin Chemicals Co., Ltd., Tg: 46° C., vinyl chloride unit proportion: 80%) | 21 mass parts |
| Gelatin (10% aqueous solution> | 10 mass parts |
| Microcrystalline wax (trade name: EMUSTAR-42X, manufactured by Nippon Seiro Co., Ltd.) | 1 mass parts |
| Fluorine-based release agent (trade name: Megafac F-472F, manufactured by Dainippon Ink and Chemicals, Inc.) | 4 mass parts |
| Water | 5 mass parts |
| NaOH aqueous solution | amount necessary for adjusting pH to 8 |

Image Formation)

Using each of the above heat-sensitive transfer sheets 101 to 115 together with the above heat-sensitive transfer image-receiving sheet 201, an image of 152 mm×102 mm in size was output by a heat-transfer type printer (trade name: ASK 2000, manufactured by FUJIFILM Corporation), respectively. On this test, heat-sensitive transfer sheets, in which the cyan part and the protective layer part of the heat-sensitive transfer sheet of ASK 2000 were replaced by each layer part of the heat-sensitive transfer sheets 101 to 115 and the protective layer laminate prepared in the above respectively, were used. The image was output in the following circumstantial conditions: temperature: 30° C. and relative humidity: 80%. The printer was put into a printable state by setting the respective heat-sensitive transfer sheets and the heat-sensitive transfer image-receiving sheet in advance and by placing the printer in advance in a room kept at 30° C. and a relative humidity of 80% for 24 hours.

Each heat-sensitive transfer sheet was used to continuously make 10 prints with the Dmax image and the protective layer was transferred thereon after the printing was finished. The reflection density after the protective layer was transferred was measured by a Color Densitometer X-rite 310 TR (trade name, manufactured by X-rite). Also, the evaluations of irregular transfer and gloss unevenness were made visually to rate each result into the following five ranks. The results are shown in Table 2 below. The result is better with increase in number. Among these five ranks, the rank 4 or more is in an allowable level.

TABLE 2

| Heat-sensitive transfer sheet | Dmax | Irregular transfer | Gloss unevenness | Remarks |
|---|---|---|---|---|
| 101 | 1.99 | 4 | 3 | Comparative example |
| 102 | 1.99 | 4 | 2 | Comparative example |
| 103 | 2.03 | 5 | 2 | Comparative example |
| 104 | 2.01 | 5 | 2 | Comparative example |
| 105 | 2.17 | 5 | 5 | This invention |
| 106 | 2.18 | 5 | 5 | This invention |
| 107 | 2.16 | 5 | 4 | This invention |
| 108 | 2.21 | 5 | 5 | This invention |
| 109 | 2.23 | 5 | 5 | This invention |
| 110 | 1.94 | 5 | 3 | Comparative example |
| 111 | 1.91 | 5 | 3 | Comparative example |
| 112 | 1.90 | 5 | 3 | Comparative example |
| 113 | 1.90 | 5 | 3 | Comparative example |
| 114 | 1.99 | 2 | 2 | Comparative example |
| 115 | 2.02 | 3 | 2 | Comparative example |

As is clear from Table 2, the heat-sensitive transfer sheets of the present invention had higher Dmax values than the heat-sensitive transfer sheets of Comparative examples, were free from irregular transfer, and produced substantially no gloss unevenness.

Example 2

(Preparation of Heat-Sensitive Transfer Image-Receiving Sheet 202)

Heat-sensitive transfer image-receiving sheet 202 was prepared in the same manner as the heat-sensitive transfer image-receiving sheet 201, except that the receptor layer-coating liquid was replaced with the following receptor layer-coating liquid.

<Receptor Layer-Coating Liquid>

| | |
|---|---|
| Polyester-series latex (trade name: VYLONAL MD-1200 (Tg 67° C.), manufactured by Toyobo Co., Ltd.) | 49 mass parts |
| Polyester-series latex (trade name: VYLONAL MD-1500 (Tg 77° C.), manufactured by Toyobo Co., Ltd.) | 21 mass parts |
| Gelatin (10% aqueous solution) | 10 mass parts |
| Microcrystalline wax (trade name: EMUSTAR-42X, manufactured by Nippon Seiro Co., Ltd.) | 5 mass parts |
| Water | 5 mass parts |
| NaOH aqueous solution | amount necessary for adjusting pH to 8 |

(Image Formation)

Next, the same printing operation was made in the same manner as in Example 1, except that the heat-sensitive transfer sheet 107 was used and the heat-sensitive transfer image-receiving sheet 202 was used in place of the above heat-sensitive transfer image-receiving sheet 201, and as a result, good results were obtained.

Example 3

(Preparation of Heat-Transfer Image-Receiving Sheet 203)

A synthetic paper (trade name: Yupo FPG 200, manufactured by Yupo Corporation, thickness: 200 μm) was used as the support; and, on one surface of the support, a receptor layer, having the following compositions, was coated. The coating was carried out such that the amount of the receptor layer after the layer was dried at 50° C. in 30 seconds would be 4.0 g/m$^2$.

Receptor Layer

| | |
|---|---|
| Vinyl chloride/vinyl acetate copolymer (trade name: Solbin A, manufactured by Nisshin Chemicals Co., Ltd.) | 100 mass parts |
| Amino-modified silicone (trade name: X22-3050C, manufactured by Shin-Etsu Chemical Co., Ltd.) | 5 mass parts |
| Epoxy-modified silicone (trade name: X22-3000E, manufactured by Shin-Etsu Chemical Co., Ltd.) | 5 mass parts |
| Methyl ethyl ketone/toluene (1/1, at mass ratio) | 400 mass parts |

(Image Formation)

Using the above heat-sensitive transfer sheet 101 and the above heat-sensitive transfer image-receiving sheet 203, a cyan part of an image of 152 mm×102 mm in size was output by a heat-transfer type printer (trade name: ASK 2000, manufactured by FUJIFILM Corporation) and in succession, the protective layer was transferred thereon. As the image, a landscape image having many highlight parts was used. The image was output in the following circumstantial conditions: temperature: 10° C. and relative humidity: 15%. The printer was put into a printable state by setting the heat-sensitive transfer sheet 101 and the heat-sensitive transfer image-receiving sheet 203 in advance and by placing the printer in advance in a room kept at 10° C. and a relative humidity of 15% for 24 hours. The printed product had higher lack of uniformity on the highlight parts.

Next, a print of the landscape image was formed in the same manner as the above, except that the heat-sensitive transfer sheet 108 was used in place of the heat-sensitive transfer sheet 101. As a result, no lack of uniformity was observed on the highlight parts, exhibiting better print quality.

The printer was put into a printable state by setting the heat-sensitive transfer sheet 108 and the heat-sensitive transfer image-receiving sheet 203 in advance and by placing the printer in advance in a room kept at 30° C. and a relative humidity of 80% for 24 hours. When the Dmax image of cyan was printed, and no gloss unevenness was found, showing good print results.

Having described our invention as related to the present embodiments, it is our intention that the invention not be limited by any of the details of the description, unless otherwise specified, but rather be construed broadly within its spirit and scope as set out in the accompanying claims.

What we claim is:

1. A heat-sensitive transfer sheet at least having a polyester support, a barrier layer, and a heat-sensitive transfer layer containing a dye and a binder, both layers being applied on a surface of the support in this order, and having the heat-sensitive transfer layer including yellow, magenta, and cyan heat-sensitive transfer layers, and the yellow, magenta, and cyan heat-sensitive transfer layers and a protective layer being formed in area order, wherein the barrier layer contains a polyvinylpyrrolidone and the cyan heat-sensitive transfer layer contains at least one silicone oil and at least one dye represented by the following formula (C1):

Formula (C1)

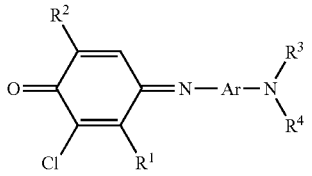

wherein Ar represents a substituted or unsubstituted p-phenylene group; $R^1$ represents a substituted or unsubstituted alkyl group; $R^2$ represents a substituted or unsubstituted acylamino group, or a substituted or unsubstituted alkoxycarbonylamino group; $R^3$ and $R^4$ each independently represent a substituted or unsubstituted alkyl group, a substituted or unsubstituted alkenyl group, or a substituted or unsubstituted aryl group.

2. The heat-sensitive transfer sheet according to claim 1, wherein the barrier layer further contains inorganic fine particles selected from the group consisting of colloidal silica, colloidal alumina, magnesium silicate, magnesium carbonate and titanium oxide.

3. The heat-sensitive transfer sheet according to claim 2, wherein the barrier layer further comprises a polyvinyl alcohol.

4. The heat-sensitive transfer sheet according to claim 1, wherein the heat-transfer layer contains the at least one silicone oil in an amount of 0.1 to 15% by mass based on the amount of binder.

5. The heat-sensitive transfer sheet according to claim 1, wherein the barrier layer further comprises a polyvinyl alcohol.

6. An image forming method comprising:

providing a heat-sensitive transfer sheet at least having a polyester support, a barrier layer, and a heat-sensitive transfer layer containing a dye and a binder, both layers being applied on a surface of the support in this order, and having the heat-sensitive transfer layer including yellow, magenta, and cyan heat-sensitive transfer layers, and the yellow, magenta, and cyan heat-sensitive transfer layers and a protective layer being formed in area order; and a heat-sensitive transfer image-receiving sheet at least having a support, and a receptor layer which receives the dyes transferred from the heat-sensitive transfer sheet, on a surface of the support, and transferring the dyes contained in the heat-sensitive transfer layers to the receptor layer of the heat-sensitive transfer image-receiving layer by applying heat to the heat-sensitive transfer sheet from a thermal head to thereby form an image, wherein the heat-sensitive transfer sheet contains a polyvinylpyrrolidone in the barrier layer and the cyan heat-sensitive transfer layer contains at least one silicone oil and at least one dye represented by the following formula (C1):

Formula (C1)

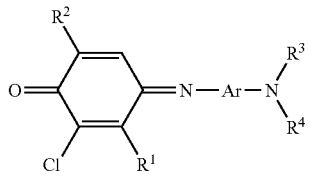

wherein Ar represents a substituted or unsubstituted p-phenylene group; $R^1$ represents a substituted or unsubstituted alkyl group; $R^2$ represents a substituted or unsubstituted acylamino group, or a substituted or unsubstituted alkoxycarbonylamino group; $R^3$ and $R^4$ each independently represent a substituted or unsubstituted alkyl group, a substituted or unsubstituted alkenyl group, or a substituted or unsubstituted aryl group.

7. The image forming method according to claim 6, wherein the barrier layer of the heat-sensitive transfer sheet further contains inorganic fine particles selected from the group consisting of colloidal silica, colloidal alumina, magnesium silicate, magnesium carbonate and titanium oxide.

8. The image forming method according to claim 7, wherein the barrier layer further comprises a polyvinyl alcohol.

9. The image forming method according to claim 6, wherein the heat-sensitive transfer image-receiving sheet contains at least one type of latex polymer in the receptor layer.

10. The image forming method according to claim 6, wherein the above latex polymer is a vinyl chloride type latex polymer.

11. The image forming method according to claim 6, wherein the heat-transfer layer contains the at least one silicone oil in an amount of 0.1 to 15% by mass based on the amount of binder.

12. The image forming method according to claim 6, wherein the barrier layer further comprises a polyvinyl alcohol.

* * * * *